US010709932B2

(12) United States Patent
Herring

(10) Patent No.: US 10,709,932 B2
(45) Date of Patent: Jul. 14, 2020

(54) EXERCISE APPARATUS AND METHOD

(71) Applicant: Jonathan Andrew Herring, Hamilton (BM)

(72) Inventor: Jonathan Andrew Herring, Hamilton (BM)

( * ) Notice: Subject to any disclaimer, the term of this patent is extended or adjusted under 35 U.S.C. 154(b) by 84 days.

(21) Appl. No.: 16/049,697

(22) Filed: Jul. 30, 2018

(65) Prior Publication Data

US 2020/0030660 A1 Jan. 30, 2020

(51) Int. Cl.

| | |
|---|---|
| ***A63B 23/04*** | (2006.01) |
| ***A63B 21/008*** | (2006.01) |
| ***A63B 21/04*** | (2006.01) |
| ***A63B 21/00*** | (2006.01) |

(52) U.S. Cl.

CPC .... *A63B 23/0482* (2013.01); *A63B 21/00069* (2013.01); *A63B 21/0087* (2013.01); *A63B 21/00192* (2013.01); *A63B 21/0407* (2013.01); *A63B 21/156* (2013.01); *A63B 21/4029* (2015.10); *A63B 21/4039* (2015.10); *A63B 2208/0252* (2013.01)

(58) Field of Classification Search

CPC ..... A63B 21/00; A63B 21/00047; A63B 21/00058; A63B 21/00061; A63B 21/00065; A63B 21/00069; A63B 21/00076; A63B 21/00178; A63B 21/00189; A63B 21/002; A63B 21/0023; A63B 21/008; A63B 21/0083; A63B 21/0085; A63B 21/0087; A63B 21/02; A63B 21/023; A63B 21/025; A63B 21/04; A63B 21/0407; A63B 21/15; A63B 21/157; A63B 21/22; A63B 21/222; A63B 21/225; A63B 21/227; A63B 21/40; A63B 21/4027; A63B 21/4039; A63B 21/4041; A63B 22/00; A63B 22/0094; A63B 23/02; A63B 23/0205; A63B 23/0222; A63B 23/0227; A63B 23/0233; A63B 23/0238; A63B 2208/00; A63B 2208/02; A63B 2208/0242; A63B 2208/0247; A63B 2208/0252

See application file for complete search history.

(56) References Cited

U.S. PATENT DOCUMENTS

| | | | | |
|---|---|---|---|---|
| 2008/0085821 | A1* | 4/2008 | Webb | A63B 21/045 482/97 |
| 2016/0184629 | A1* | 6/2016 | Hornback | A63B 21/0442 482/98 |
| 2019/0099652 | A1* | 4/2019 | Orady | A63B 71/0054 |

* cited by examiner

*Primary Examiner* — Loan B Jimenez
*Assistant Examiner* — Zachary T Moore
(74) *Attorney, Agent, or Firm* — Kirk Dorius; Dorius Law P.C.

(57) ABSTRACT

An exercise apparatus and method for working the hip muscles, in particular the glute muscle groups. Said exercise apparatus includes a low-profile chassis having a front portion and a rear portion, an elongated cross member having a pair of hip/lap cushions, a foot platform slidably mounted on the chassis, a shoulder/back support mounted on a support frame, a resistance member for loading the muscles of a user and a variable transmission adapted to act as a variable diameter pulley configured to reduce the input force required for a user to overcome the resistance member force.

17 Claims, 17 Drawing Sheets

EXERCISE APPARATUS AND METHOD

CROSS-REFERENCE TO RELATED APPLICATIONS

N/A

FIELD OF INVENTION

This invention generally relates to exercise apparatuses and methods, in particular, to variable resistance apparatuses and methods for exercising major muscle groups.

BACKGROUND OF THE INVENTION

Various mechanical means have been proposed to target the gluteus maximus ("glute") and related muscle groups. Studies have shown that effective glute strengthening can be performed by having the feet planted on the floor or stable surface, and the upper back supported on a bench or surface on a higher lateral plane than the feet. The hips are loaded by placing a barbell or other loaded cross member across hip area, traditionally a barbell across the lower abdomen at the lowest point when the hip is at flexion at the bottom of the motion range. The exercise is performed by initiating hip extension, driving the load upwards to the end range of the hip's extension and then returning to hip flexion.

The traditional barbell weighted hip thrust exercise loads the hip joint by placing the barbell directly across the front of the hips and the lower abdomen. This can be extremely uncomfortable and/or painful, especially as the loading increases. The small contact area, and straight shape of the barbell applies great pressure to the skin and internal organs of the area, often resulting in bruising.

Currently available products do not afford both effectiveness and comfort in a compact personal apparatus for home use. As glutes are some of the biggest and strongest muscles in the human body, developing substantial strength requires heavy force loads. While bodyweight and lightweight resistance band exercises are convenient for home use, their low loading levels render them largely limited in their effectiveness. Suitable high loadings are typically only found in a gym environment, which may be inconvenient, less safe, and without privacy.

In the market, there are currently a variety of benches for gym and home use, with added foot platforms and attachment points for resistance bands. The benches for use at gyms are not portable and still require barbells, plates, and a large footprint. Apart from these benches, there are very heavy gym-style weight-stack machines. These machines are not portable and are based on either the 'kickback' or hip thrust exercise. Commercially available Hip Thruster and BootySprout are two examples of such gym equipment which comprise a bench having a platform for upper back, a foot platform and multiple attachment points for resistance bands.

Most exercise weight/force adjustment mechanisms employed in strengthening machines adjust desired output force by changing the initial input force entering the system, mainly through addition, or subtraction of a multitude of input force sources, such as weight plates in a weight stack, dumbbells, traditional springs, electromagnetic resistance, air pressure resistance, flywheel inertia, composite rods, or resistance bands/rods connected to the force delivery component (e.g. handle, cable or chain). For example, commercially available Booty Builder uses a selectorizer system including a plurality of weight plates in a stack.

Thus, prior proposed glute exercise apparatuses generally require direct addition or removal of resistance mechanisms to achieve a variety of workout loads.

Accordingly, improvements are sought in terms of cost-effective, compact apparatus for exercising the glute and related muscle groups.

SUMMARY OF THE INVENTION

While the way that the present invention addresses the disadvantages of the prior art will be discussed in greater detail below, in general, the present invention provides a compact, low profile, fully integrated, lightweight, size-adjustable, user-friendly exercise apparatus for strengthening the gluteus maximus ("glute") and related muscle groups.

It is an object of the present invention to provide an exercise apparatus to allow users to perform hip/glute strengthening exercises in a safe, comfortable, and effective manner. The exercise apparatus of the present invention takes traditional barbell weighted hip thrust exercise and improves upon it by incorporating a variable resistance transmission, reducing the footprint of the area needed to perform the exercise, reducing the size and weight of the equipment needed to perform the exercise, increasing the comfort of the contact areas on the upper back and the hips and, improving the safety of the exercise.

It is another object of the present invention to provide an easy to use, continuously (i.e., non-incremental) variable resistance exercise apparatus for performing hip/glute strengthening exercises over a wide adjustable range of resistance levels to be enjoyed by the user.

In accordance with various embodiments of the present invention, a compact, low-profile, fully-integrated, size-adjustable, user-friendly exercise apparatus for training the muscles of the lower trunk of the human body is provided. Specifically, the apparatus is designed to train the gluteus maximus and related muscle groups.

In accordance with an illustrative embodiment of the present invention, the exercise apparatus comprises a low-profile chassis having a front portion and a rear portion; a foot platform; a shoulder/back support; a handlebar; a plurality of wheels and a cross member. The chassis also includes a pair of actuator spools provided on the sides of the chassis, and an adjustment knob for selection from a wide range of resistance forces by adjustment of a variable transmission coupled to a resistance mechanism.

In accordance with various embodiments of the present invention, the exercise apparatus further includes a resistance member and a variable transmission, housed inside the chassis.

In accordance with a preferred embodiment of the present invention, the exercise apparatus comprises a cross-member engineered to replicate the action of a traditional barbell or gym apparatus utilized in conventional hip strengthening exercises such as weighted hip thrust exercise. It is intended to be suitable for home use. In various embodiments, the cross-member can include pads, belts or straps to engage or secure the users hips, legs, or otherwise.

In accordance with another preferred embodiment of the present invention, the exercise apparatus provides a high-quality, easily adjustable, variable resistance to load the muscles of the user without the use of weights. The resistance system is contained within the low-profile chassis of the exercise apparatus. The resistance system primarily comprises a resistance source, for example, but not limited to, a constant force spring. There are no weight plates or bars to lift and move during set up and load adjustment. Other embodiments may include other resistance mechanisms such as mechanical tension spring, a mechanical strut, a constant force spring, a gas spring, an air piston, a magnetic spring or a combination thereof.

In accordance with another preferred embodiment of the present invention, the resistance system is further coupled to a variable transmission via a coupling mechanism including a cable and a bracket. The variable transmission serves to establish by gear reduction the amount of resistance transferred to the front of the user's hip joint and therefore glute muscles during the upward action of hip extension. The amount of resistance can be adjusted by changing the gear ratios within the transmission, e.g., at a turn of the adjustment knob.

According to one aspect of the invention features, in some embodiments, an exercise apparatus for performing hip strengthening exercises is provided. The exercise apparatus includes a chassis having a front portion and a rear portion; an elongated cross member having a pair of hip/lap cushions, wherein the cross member is detachably coupled to the chassis and connected to the resistance system via a pair of webbing straps/cables; a foot platform provided slidably mounted on the chassis towards the rear portion; a shoulder/back support hingably mounted on a support frame, provided towards the front portion of the chassis, wherein the said support frame can be positioned in multiple fore-and-aft positions with respect to the chassis and allows the shoulder/back support to be deployed outside the chassis in an elevated position during the use of the exercise apparatus; a resistance member disposed within the chassis serving as a source of resistance/input force, provided for loading the hips/hip muscles of a user; and, a variable transmission configured to establish/reduce the resistance force transferred to the user.

In some embodiments, the cross member further includes a pair of handles configured to detachably couple the cross member with the chassis via the pair of webbing straps/cables.

In some embodiments, the hip/lap cushions have a concave underside, a plurality of curvatures on their side faces and a longitudinal slot. The longitudinal slots configured to receive a portion the cross member.

In some embodiments, the exercise apparatus comprises one or more resistance member(s), wherein at least one resistance member is selected from the group consisting of a mechanical tension spring, a mechanical strut, a constant force spring, a gas spring, an air piston, a magnetic spring or a combination thereof. Preferably, at least one resistance member is a constant force spring.

In some embodiments, the resistance force received by the user is a fraction of the input force required to operate the resistance mechanism.

In preferred embodiments, the exercise apparatus further includes an adjustment knob provided with a plurality of markings indicating various gear ratios and/or loading levels, configured to adjust the desired gear ratio of the variable transmission.

In various embodiments, the variable transmission acts as a variable diameter pulley and comprises a top large gear with a plurality of slots extending radially; a bottom large gear with a plurality of curved slots, a plurality of slider bearings; a locking idler drum gear assembly comprising a first half locking idler drum gear and a second half locking idler drum gear; an idler gear configured to engage the bottom large gear; and, a drive/output gear configured to engage the bottom large gear, wherein each one of the said slider bearings is disposed within one radial slot and one curved slot of the top and bottom large gears respectively. The said idler gear is configured to change the position of the slider bearings in their slots by rotating the bottom large gear when the first and second half locking idler drum gears are disengaged from one another and the top large gear is held still. The said locking idler drum gear assembly is configured to prevent independent rotation of the top and bottom large gears and displacement of slider bearings within their respective slots under load when the first and second half locking idler drum gears are engaged with one another.

In various embodiments, the exercise apparatus further includes a cable to operatively couple the resistance member and the variable transmission wherein at least one of the aforementioned slider bearings is anchored to one end of the cable and configured to act as a variable diameter pulley. The cable may be run directly between the resistance member and the variable transmission or it may go through a series of pullies with the intent to optimize the positioning of each component. When the transmission is rotated about its axis the cable is wound at a specific diameter and the resistance member is extended. This extension causes a force to be transmitted from the resistance member through the cable/pulley assembly, through the transmission, through the spools/straps to the hip bar.

Another aspect of the invention features, in some embodiments, a method for performing an exercise is provided. The method comprises providing an exercise apparatus including: a low-profile chassis having a front portion and a rear portion; an elongated cross member having a pair of hip/lap cushions and a pair of handles configured to detachably couple the cross member to the chassis via a pair of webbing straps/cables, wherein said hip/lap cushions have a concave underside, a plurality of curvatures on their side faces and a longitudinal slot configured to receive a portion the cross member; a slidably mounted foot platform provided towards the rear portion of the chassis; a shoulder/back support hingably mounted on a support frame which can be positioned in multiple fore-and-aft positions with respect to the chassis and allows the shoulder/back support to be located outside the chassis in an elevated position during the use of the exercise apparatus; a resistance member disposed within the chassis for loading the cross-member/hip muscles of a user; and a variable transmission configured to establish/reduce the effective resistance of the resistance mechanism transferred to the user, placing a portion of the upper torso of the user on the shoulder/back support, placing the feet of the user on the foot platform; locating the cross member across a portion of user's body, whereafter the user performs an upward thrust using the hip muscles to extend the hip joints and move the cross member in an upward direction.

Another aspect of the invention features, in some embodiments, a method of performing an exercise, comprising: providing an exercise apparatus, the exercise apparatus including: (a) a chassis having a front portion and a rear portion; (b) an elongated cross member moveably coupled to the chassis, (c) a foot platform provided towards the rear portion of the chassis; (d) a shoulder/back support provided towards the front portion of the chassis, (e) a resistance member coupled to the chassis provided for loading cross-member; and (f) a variable transmission configured to reduce in input force required at the cross-member to overcome a resistance force of the resistance member; placing a portion of upper torso of the user on the shoulder/back support; placing the feet of the user on the foot platform; locating the cross member across a portion of user's body; whereafter the user performs an upward thrust using the hip muscles to move the cross member in upward direction.

In some embodiments, the exercise apparatus comprises a plurality of resistance members. In some embodiments, the resistance member(s) is selected from the group consisting of a mechanical tension spring, a mechanical strut, a constant force spring, a gas spring, an air piston, a magnetic spring or a combination thereof.

In some embodiments, the exercise apparatus further includes an adjustment knob provided with a plurality of markings indicating various gear ratios and/or loading levels, configured to adjust the desired gear ratio of the variable transmission.

In some embodiments, the cross member is located across the user's lap or hips and, wherein a hip/lap cushion of the cross-member generally conforms to the convex shape of the user's pelvis at hip flexion.

Another aspect of the invention features, in some embodiments, a method of performing an exercise comprising: providing an exercise apparatus, the exercise apparatus including:

(a) a chassis having a front portion and a rear portion;

(b) an elongated cross member coupled to the chassis and a transmission and/or resistance source/system.

(c) a foot platform provided towards the rear portion of the chassis;

(d) a shoulder/back support provided towards the front portion of the chassis;

(e) a resistance member coupled to the chassis to provide a resistance force to a desired exercise movement; and, (f) a variable transmission configured to translate an input force of an exercise movement at a selected gear ratio into an output force of the variable transmission to overcome the resistance force of the resistance mechanism, (g) an adjustment knob provided with a plurality of markings indicating various gear ratios and/or loading levels, configured to adjust the desired gear ratio of the variable transmission; placing a portion of upper torso of the user on the shoulder/back support;

placing the feet of the user on the foot platform;

locating the cross member across a portion of user's body; whereafter the user performs an upward thrust using the hip muscles to move the cross member in upward direction.

Another aspect of the invention, features, in some embodiments, contoured pads or cushions designed to minimize the pressure points over a portion of user's lower body, preferably across user's hips/lap. The pads/cushions are attached to a rigid cross member such as a metal tube or barbell or similar force transfer structure during the action of loaded hip muscle strengthening exercises. In some cases, the pad/cushion features a concave underside, a plurality of curvatures on its side-faces and a longitudinal slot or method by which to attach to the cross member, barbell, or other structure.

BRIEF DESCRIPTION OF THE DRAWINGS

A more complete understanding of the present invention may be derived by referring to the detailed description and claims when considered in connection with the Figures, wherein like reference numerals refer to similar elements throughout the Figures.

DETAILED DESCRIPTION

The following description is of exemplary embodiments of the invention only, and is not intended to limit the scope, applicability or configuration of the invention. Rather, the following description is intended to provide a convenient illustration for implementing various embodiments of the invention. As will become apparent, various changes may be made in the function and arrangement of the elements described in these embodiments without departing from the scope of the invention as set forth herein. It should be appreciated that the description herein may be adapted to be employed with alternatively configured devices having different shapes, components, mechanisms and the like and still fall within the scope of the present invention. Thus, the detailed description herein is presented for purposes of illustration only and not of limitation. Also, same reference numbers will be used to refer to the same or similar parts throughout the drawings.

The terminology used herein is for the purpose of describing particular embodiments only and is not intended to be limiting of the invention. As used in the description of the various embodiments and the appended claims, the singular forms "a," "an," and "the" are intended to include the plural forms as well, unless the context clearly indicates otherwise. It will be further understood that the terms "comprises", "comprising", "includes", "having" and/or "including" used in the description of the various embodiments and the appended claims, specify the presence of stated features, elements, and/or components, but do not preclude the presence or addition of one or more other features, elements, components, and/or groups thereof.

Reference in the specification to "one embodiment", "some embodiments", "preferred embodiment", "another embodiment", "illustrative embodiment", "various embodiments" or "alternative embodiment" is intended to indicate that a particular feature, structure, or characteristic described in connection with the embodiment is included in at least an embodiment of the invention. The appearances of the phrase "one embodiment", "some embodiments", "preferred embodiment", "another embodiment", "illustrative embodiment", "various embodiments" or "alternative embodiment" in various places in the specification are not necessarily all referring to the same embodiment.

Figure 1A:
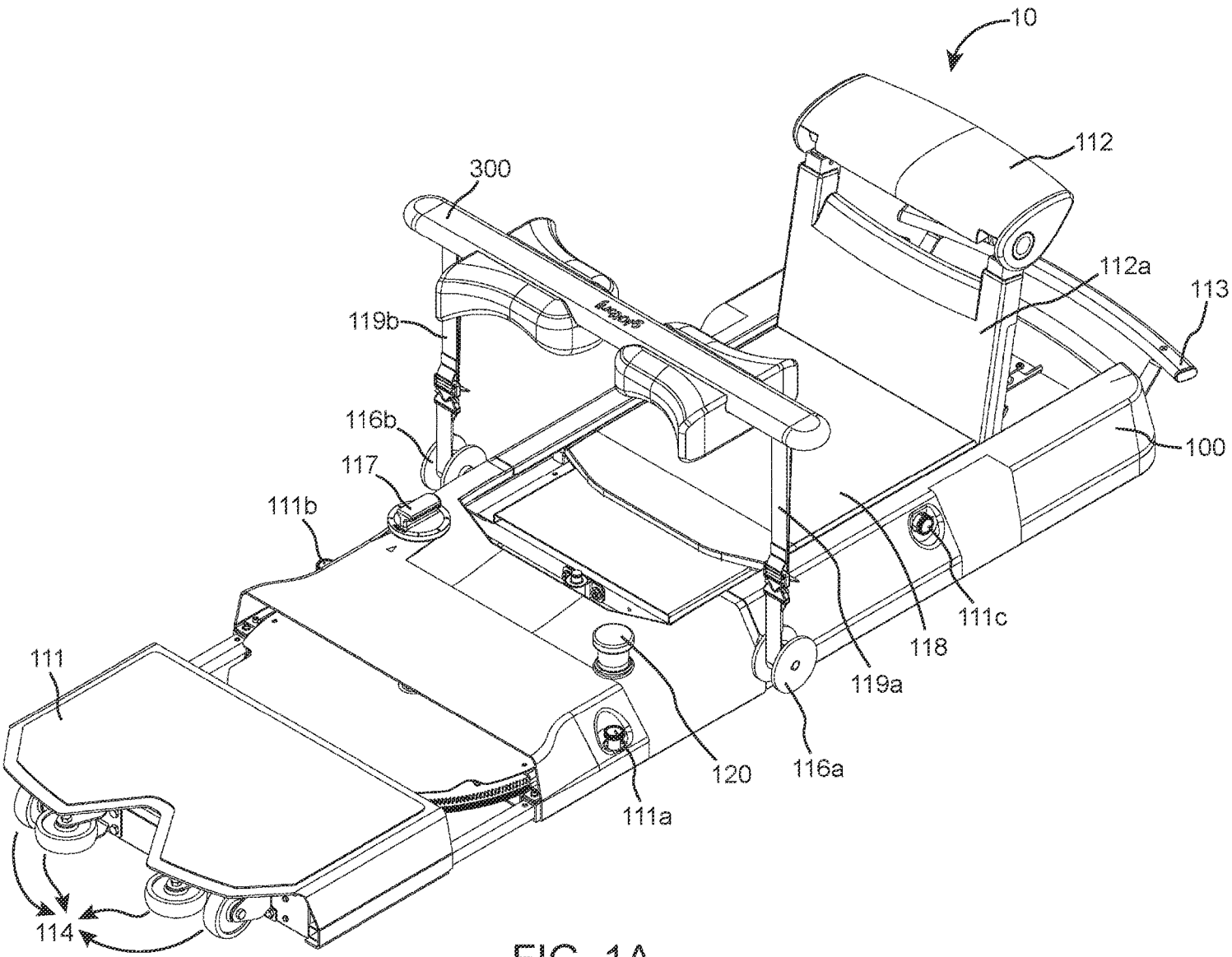
FIG. 1A is a perspective view of an exercise apparatus 10 according to an illustrative embodiment of the present invention.
Figure 2A:
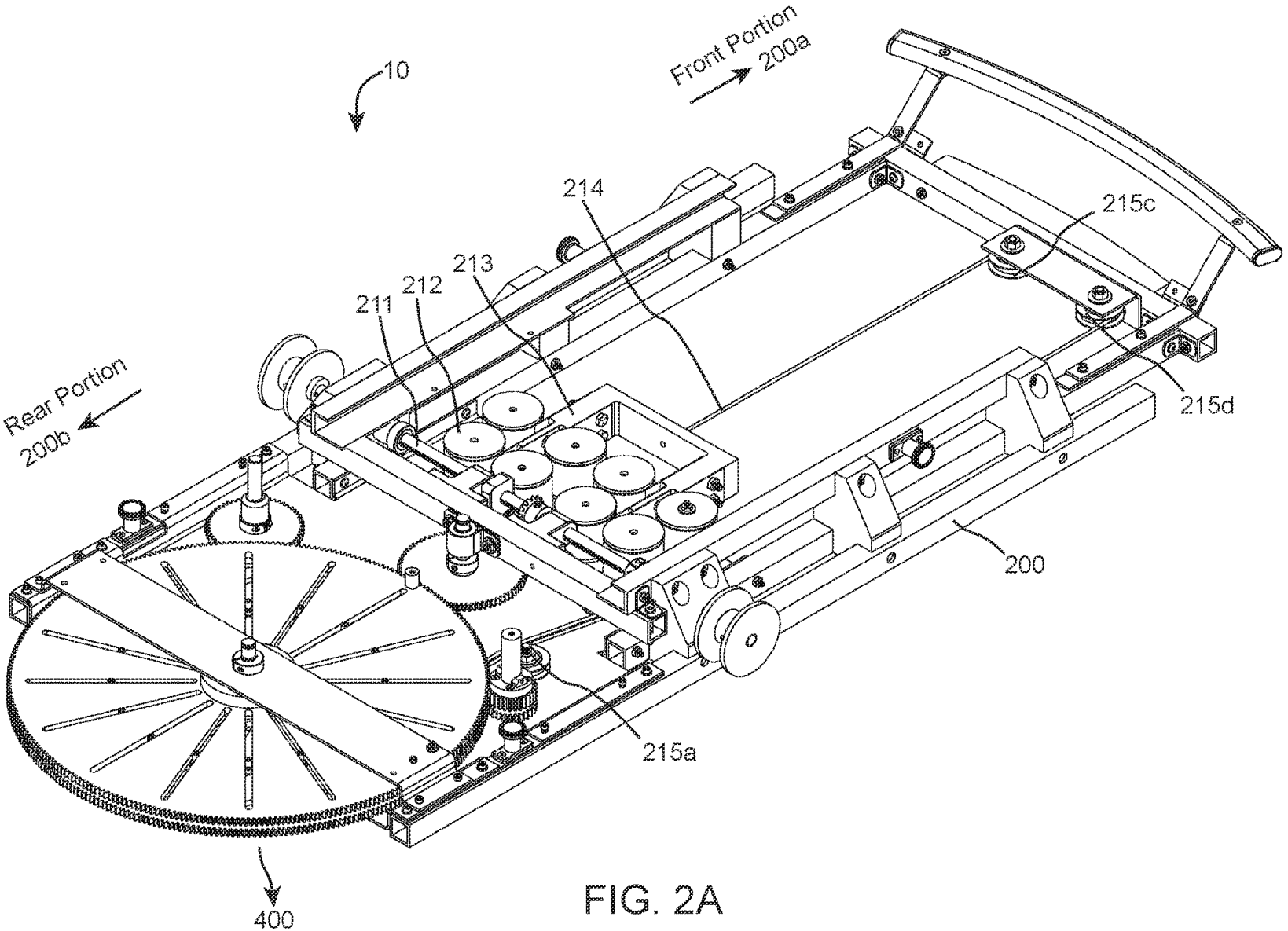
FIG. 2A is a perspective view of the exercise apparatus 10 depicting internal arrangement of various components according to a preferred embodiment.

Hereinafter, an exercise apparatus 10 in accordance with various embodiments of the present invention is described with reference to the figures. FIG. 1A is a perspective view of an exercise apparatus 10 of the present invention. FIG. 2A shows a perspective view of the exercise apparatus 10 depicting the internal arrangement of its various components.

Referring to FIG. 1A, an illustrative exercise apparatus 10 is shown. The exercise apparatus 10 includes a foot platform 111; a shoulder/back support 112; a handlebar 113; a plurality of transport wheels 114 and a cross member 300. The exercise apparatus 10 also includes a pair of actuation spools 116*a*, 116*b* (see FIG. 1D, 1E), an adjustment knob 117, a lock pull knob 120 and a seat/pylon 118. In various embodiments, the exercise apparatus 10 includes chassis fairing 100 provided to improve the aesthetics and cover the underlying chassis and various internal components.

The exercise apparatus 10 further includes an underlying low-profile chassis 200 having a front portion 200*a* and a rear portion 200*b*, as seen in FIG. 2A.

The underlying chassis 200 and various components of the exercise apparatus 10 may be made using any suitable materials, for example, but not limited to, metals such as steel, aluminum, alloys, etc., or plastics/polymers such as polyethylene, polypropylene, PVC, carbon composites etc. Alternatively, the chassis 200 may be constructed from a metal/metal, a polymer/polymer or a metal/polymer combination. Preferably, the chassis 200 is made using aluminum tubing.

The exercise apparatus 10 of the present invention is particularly a glute/hip strengthening machine designed for training the muscles of the lower trunk of the human body. Specifically, the apparatus 10 is designed to train gluteus maximus and hamstrings.

The handlebar 113 and plurality of wheels 114 provided on the exercise apparatus 10 enable ease of lifting, tilting and transport of the exercise apparatus 10. The exercise apparatus 10 of the present invention is compact and lightweight and hence can even be stored by sliding it under a bed.

Figure 1B:
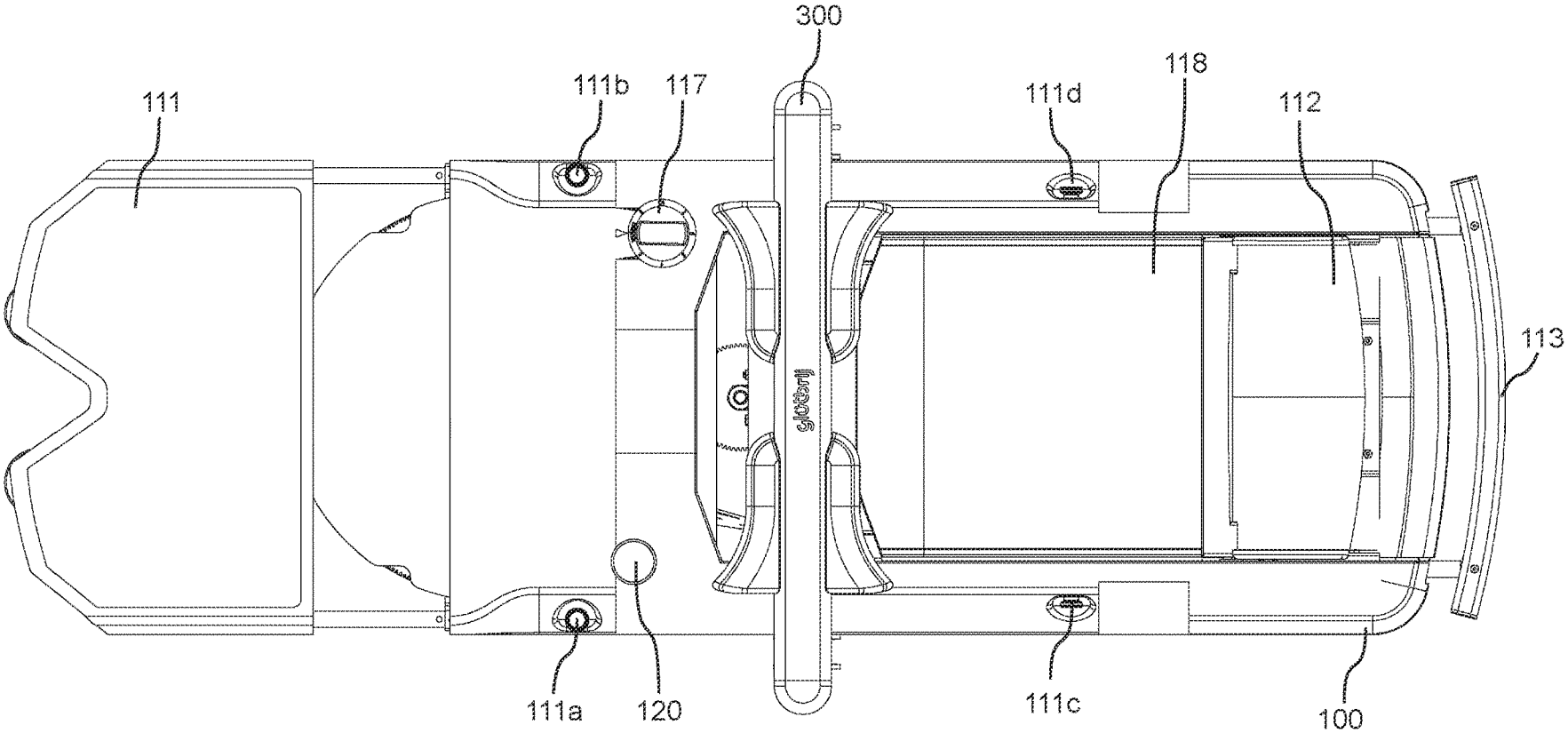
FIG. 1B is a top view of the exercise apparatus 10 of FIG. 1A according to an illustrative embodiment.
Figure 1C:
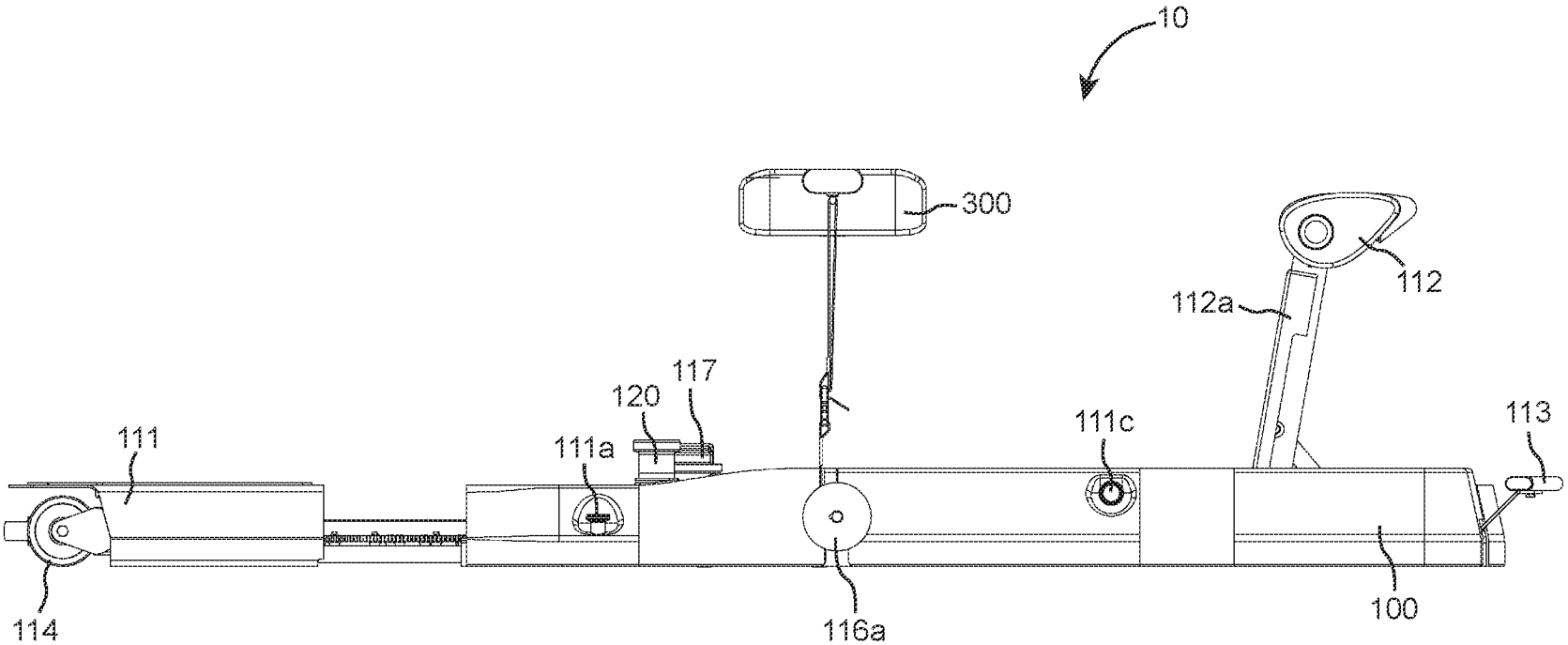
FIG. 1C is a side view of the exercise apparatus 10 of FIG. 1A according to an illustrative embodiment.
Figure 1D:
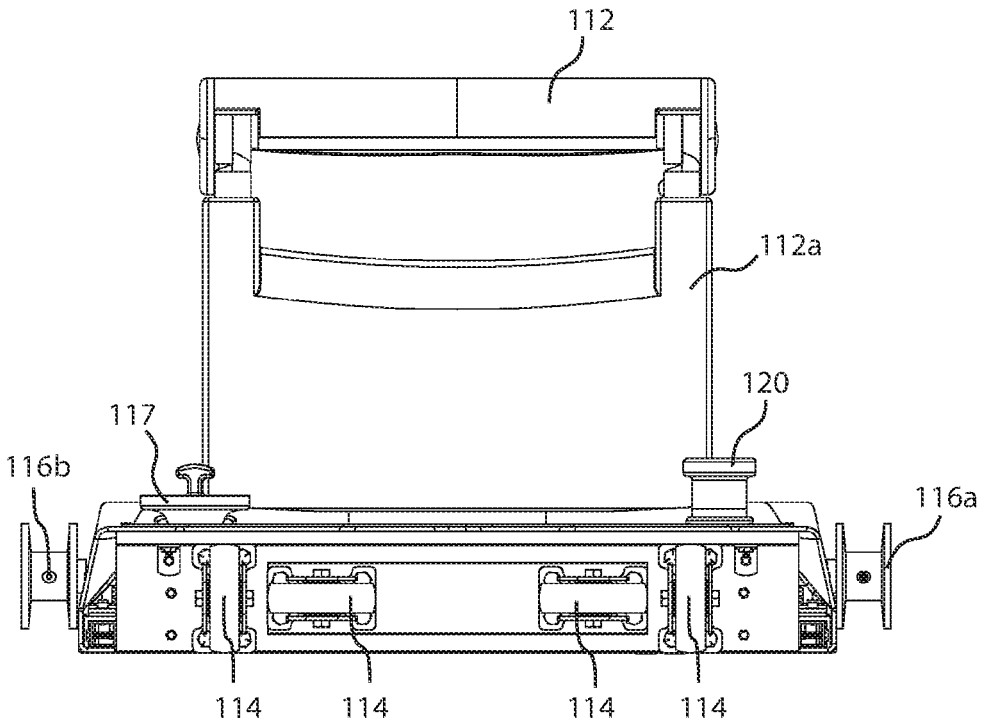
FIG. 1D is a front view of the exercise apparatus 10 of FIG. 1A according to an illustrative embodiment.
Figure 1E:
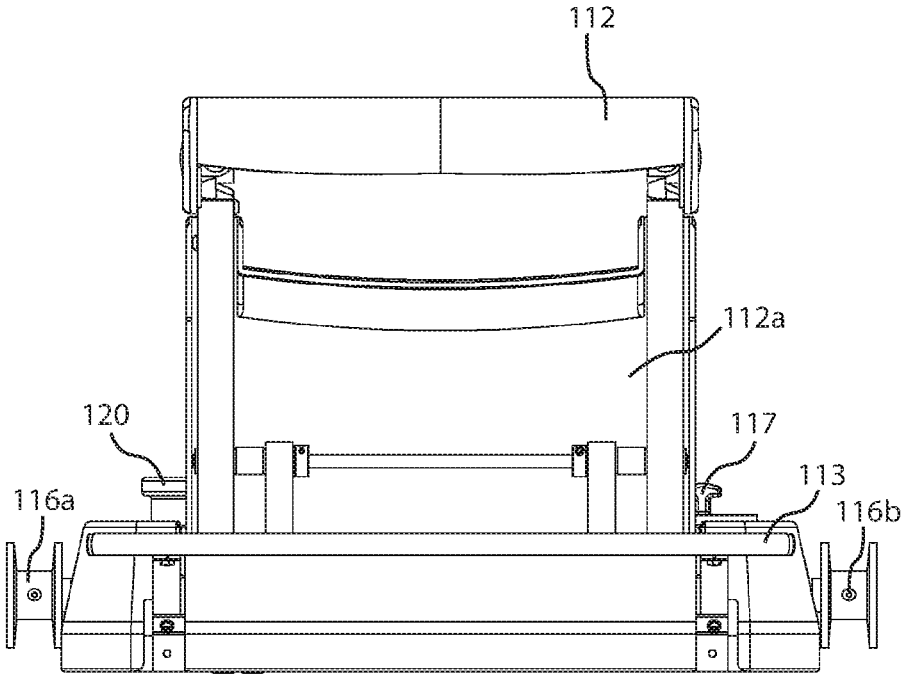
FIG. 1E is a rear view of the exercise apparatus 10 of FIG. 1A according to an illustrative embodiment.

The foot platform 111 of the exercise apparatus 10 is ergonomically designed and is provided for users to place their feet on it while performing the hip strengthening exercises such as glute bridge or hip thrust exercises. In a preferred embodiment, the foot platform 111 is telescopically mounted on the front end 200*a* of the chassis 200. The foot platform 111 can be positioned at any desired position by sliding it longitudinally with respect to the chassis 200, in order to accommodate users of different heights. Further, the foot platform 111 may be detachably mounted on the chassis 200. The relative position of the foot platform 111 with respect to the chassis 200 can be adjusted by manipulating a pair of foot platform locks 111*a*, 111*b* provided on the chassis 200 as seen in FIG. 1B.

The shoulder/back support 112 provided in the exercise apparatus 10 of the present invention allows users to position their upper body on it while performing a hip strengthening exercise. Preferably, the shoulder/back support 112 is designed in such a manner that users can position a portion of their upper torso, for example, but not limited to, shoulder blades, upper chest and/or, head in a comfortable position while performing various training exercises. The shoulder/back support 112 includes a cushioned pad designed to dissipate the weight of a user across the user's upper torso and minimize formation of pressure points. The cushioned pad is preferably made of injection or compression molded high density Ethylene-vinyl acetate or Polyurethane foam, although other suitable materials may also be used.

Figure 1F:
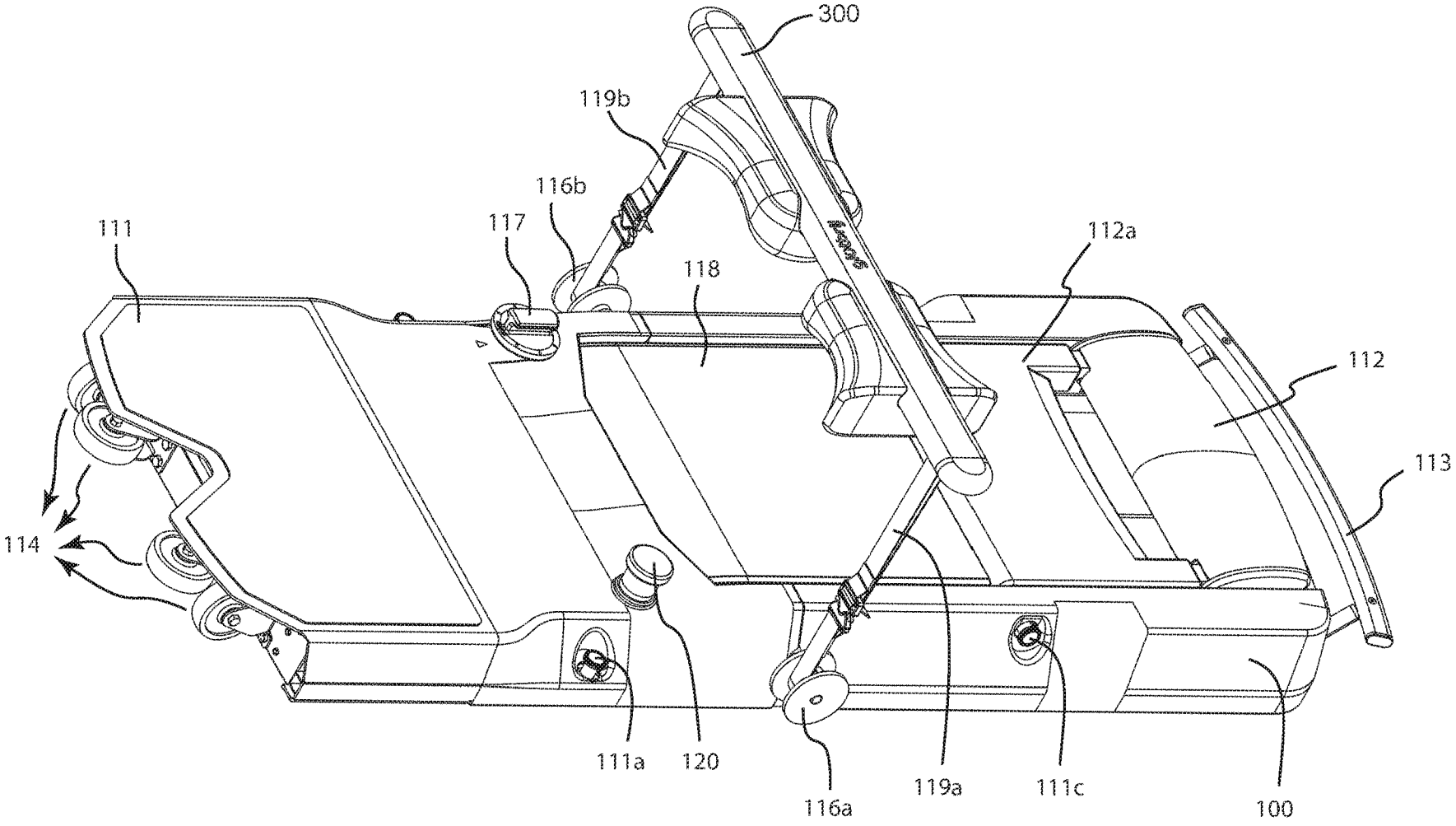
FIG. 1F is another perspective view of the exercise apparatus 10 of FIG. 1A according to an illustrative embodiment.

In a preferred embodiment, the shoulder/back support 112 is provided on the rear portion 200*b* of the chassis 200. As seen in FIG. 1A, the shoulder/back support 112 is hingably mounted on a support frame 112*a*. The support frame 112*a* is slidably housed beneath the seat/pylon 118 on the inside of the chassis 200 in a horizontal position and can be configured in a vertical position by sliding out. The support frame 112*a* allows the shoulder/back support 112 to be located outside the chassis 200 in an elevated position (as seen in FIG. 1A) during the use of the exercise apparatus 10. The support frame 112*a* also allows the shoulder/back support 112 to be stowed/located inside the exercise apparatus 10 or substantially flush (as seen in FIG. 1F) for storage. The shoulder/back support 112 can also be positioned in multiple fore-and-aft positions with respect to the chassis 200 by sliding the support frame 112*a* along the longitudinal axis of the chassis 200 in order to accommodate users having different heights. Preferably, the support frame 112*a* may be adjusted at multiple angular positions with respect to the horizontal plane, depending upon user's requirement and comfort. The relative position of the support frame 112*a* and hence that of the shoulder/back support 112 with respect to the chassis 200 may be adjusted by manipulating a pair of support frame locks 111*c*, 111*d* provided on the chassis 200 as seen in FIG. 1B. Preferably the angle of shoulder/back support 112 can be adjusted at multiple angular positions with respect to the horizontal plane. The embodiment adjustment method uses hinge(s) to control the angular positions of support 112.

Figure 3A:
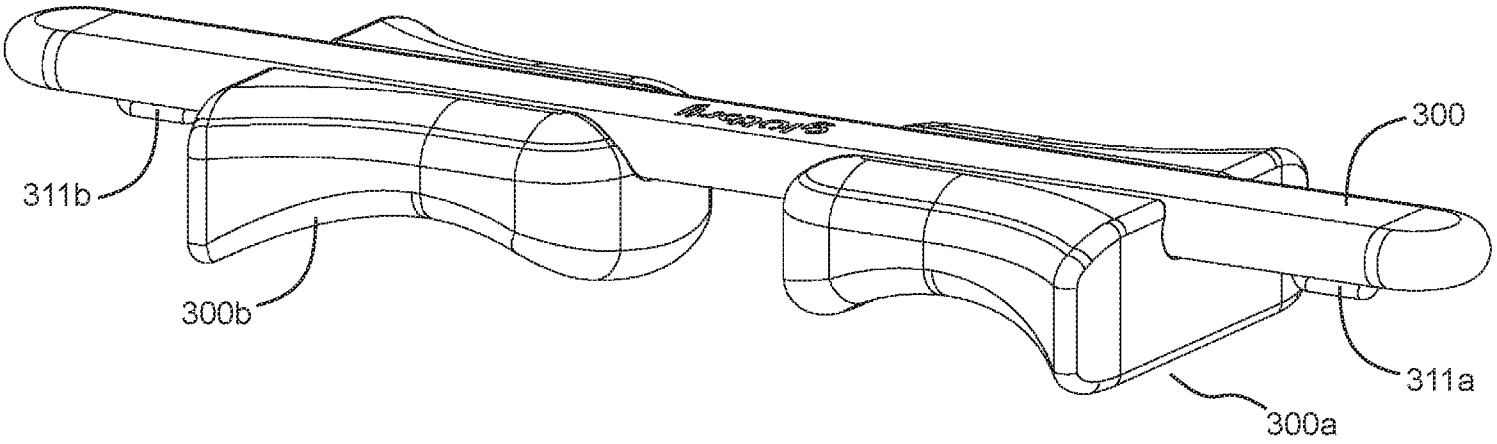
FIG. 3A is a perspective view of the cross-member 300 having a pair of hip/lap cushions according to a preferred embodiment.
Figure 3B:
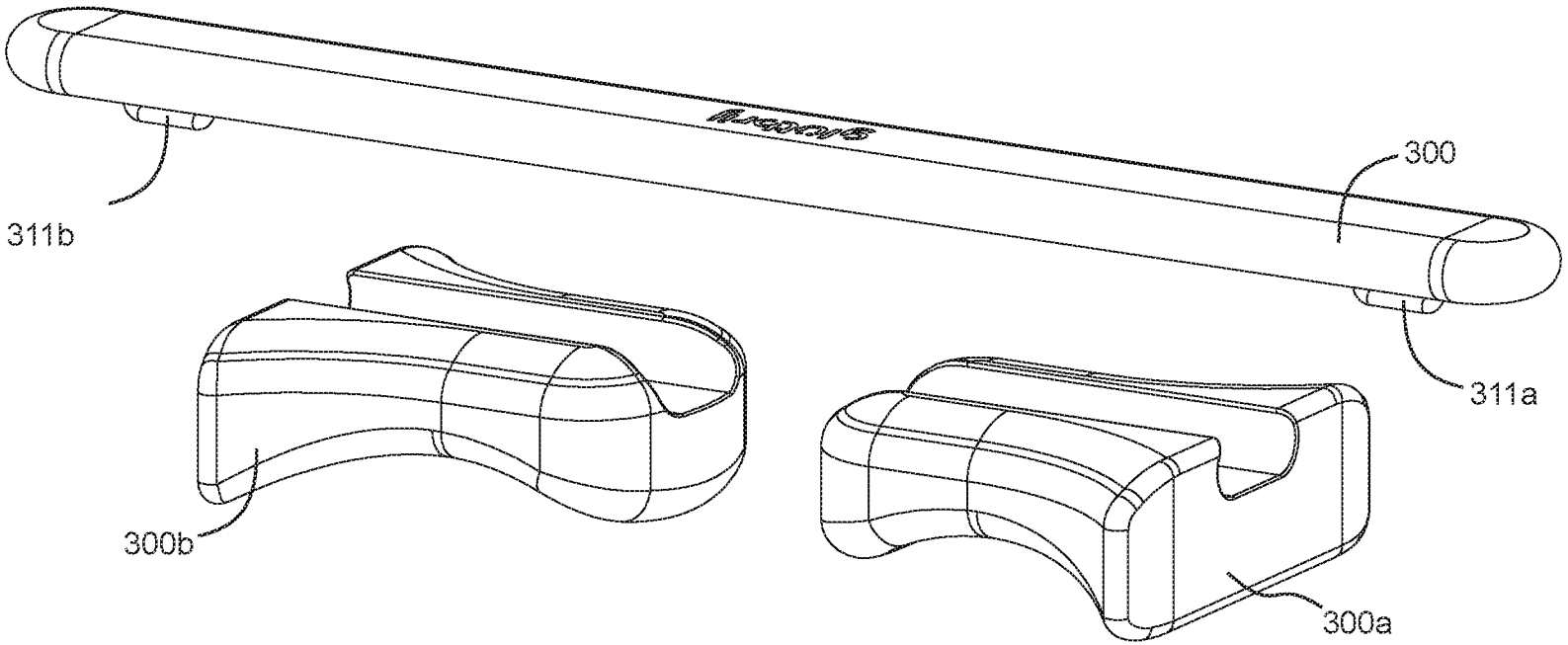
FIG. 3B shows an exploded perspective view of the cross-member 300 according to a preferred embodiment.
Figure 3C:
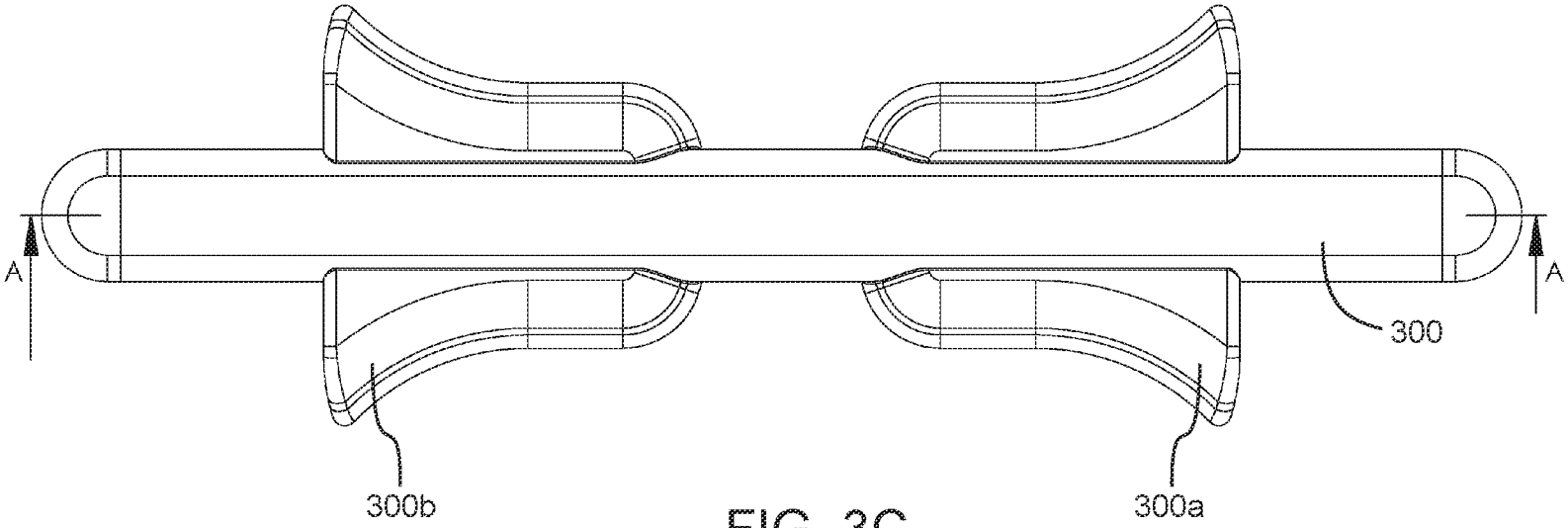
FIG. 3C shows a top view of the cross-member 300 according to a preferred embodiment.
Figure 3D:
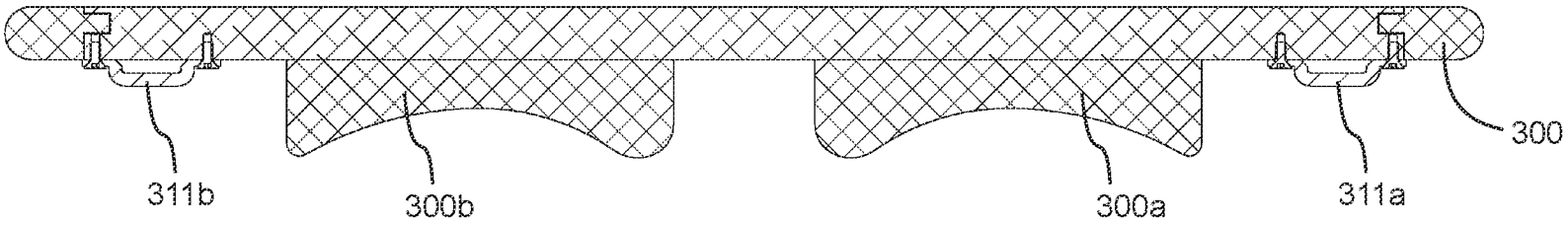
FIG. 3D shows a cross-sectional view taken along line A-A of FIG. 3C and with a pair of handles according to a preferred embodiment.

Hereinafter, embodiments related to the cross-member 300 will be described in detail. FIG. 3A is a perspective view of the cross-member 300 having a pair of hip/lap cushions 300*a*, 300*b*. The cross-member 300 of the present invention is designed to replace the traditional barbells commonly used in hip strengthening exercises and to allow comfortable loading of the hip joint while performing exercises such as the weighted/resisted hip thrust, without sacrificing the effectiveness of the exercises. The cross-member 300 is preferably made of aluminum or an alloy thereof or can be made using iron, steel or any other suitably strong plastic/polymer. As seen in FIG. 3C, the cross-member 300 has an elongated rectangular shape, however, it may be noted that the cross-member 300 can be of any shape and size depending upon the requirements.

In accordance with a preferred embodiment, a pair of hip/lap cushions 300*a*, 300*b* and a pair of handles 311*a*, 311*b* are provided on the cross-member 300. The hip/lap cushions 300*a*, 300*b* are designed to minimize the pressure points over a portion of user's lower body, preferably across user's hips/lap. The hip/lap cushions 300*a*, 300*b* may be made using any suitable material. Preferably, the cushions 300*a*, 300*b* are made of injection or compression molded high density Ethylene-vinyl acetate or Polyurethane foam. As shown in FIG. 3B, each cushion 300*a*, 300*b* features a concave underside, a plurality of curvatures on its side-faces and a longitudinal slot. The said features make the cushions 300*a*, 300*b* ergonomic during heaving loading and exercise. The concave underside helps in locating the cushions 300*a*, 300*b* over the user's thighs and minimizes pressure points. The plurality of curvatures on the side-faces, particularly on the elongated side-faces, are designed to conform to the convex shape of the user's pelvis at hip flexion and prevents the load from sliding further towards the hip joint at the bottom of the rep range i.e., when the hip is in flexion, by anatomically cradling the front outer areas of the pelvis/hips. In combination, these two features keep the load stable and stationary on the user's lap throughout the motion range and dissipate the pressure of the load to a large contact area, thereby avoiding formation of pressure points throughout the training period.

The longitudinal slots provided on the cushions 300*a*, 300*b* are configured to receive and tightly grip the cross-member 300. The longitudinal slots allow users to mount the cushions 300*a*, 300*b* on the cross-member 300 at any number of locations and at any distance in between them, as per choice. In a preferred embodiment, the cushions 300*a*, 300*b* are detachable and slidably mounted over the cross-member 300. In an alternate embodiment, the cushions 300*a*, 300*b* are not detachable, however can be slid across the cross-member 300 to adjust their location as per choice. In another preferred embodiment of the present invention, the cushions 300*a*, 300*b* are designed to be reversible and can be used on either the left or right side. Alternately, the right and left side specific cushion shapes may also be designed.

Figure 3E:
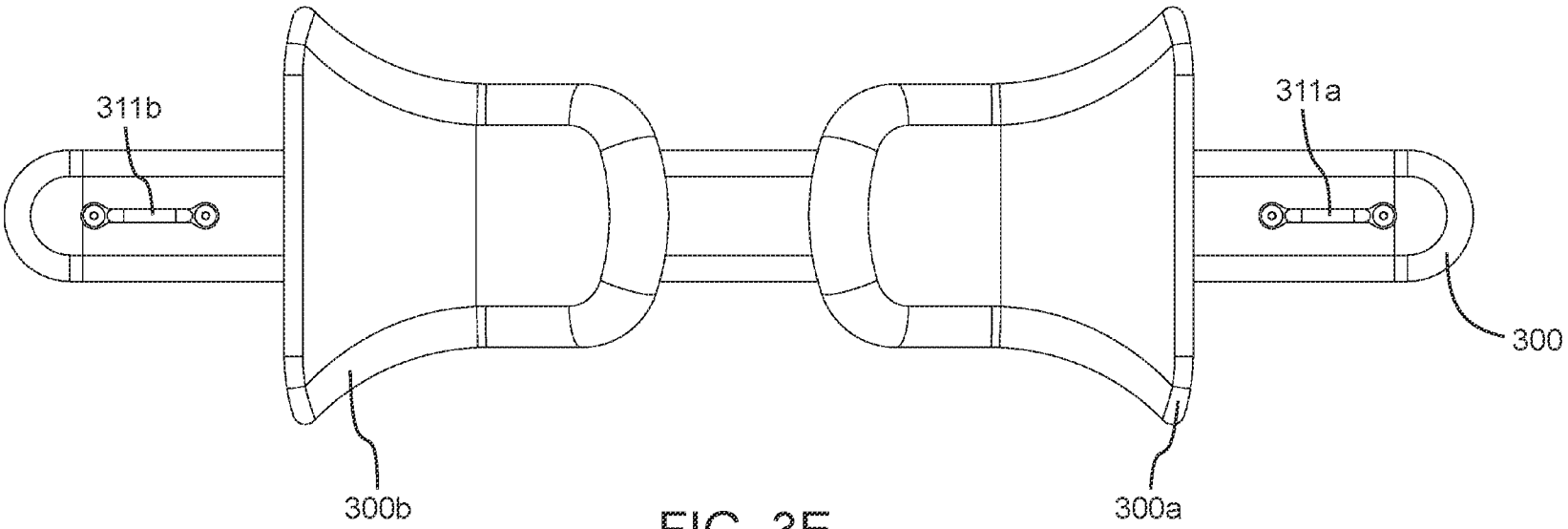
FIG. 3E shows a bottom view of the cross-member 300 according to a preferred embodiment.
Figure 3F:
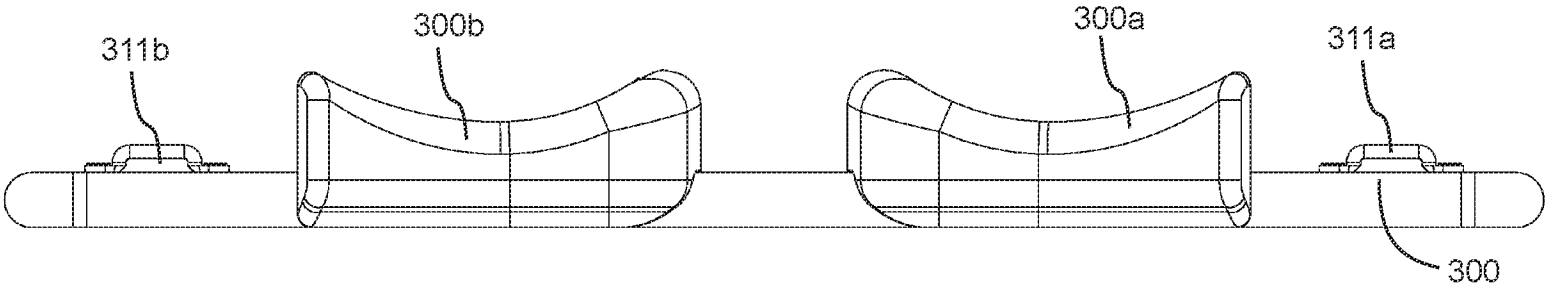
FIG. 3F shows a side view of the cross-member 300 according to a preferred embodiment.

The pair of handles 311*a*, 311*b* (see FIG. 3E, 3F) provided on the cross-member 300 allow the cross-member 300 to be detachably coupled to the chassis 200, using a pair of webbing straps/cables 119*a*, 119*b* which are partially wrapped around the spools 116*a*, 116*b*, as seen in FIG. 1A. Apart from handles 311*a*, 311*b*, other type of structures for example, but not limited to, hooks, clamps, latches, brackets, braces, clips etc. can be employed as substitutes, in accordance with various embodiments of the present invention. Alternatively, the webbing straps/cables could run inside a hollow cross-member, for example, with the addition of guides to smooth the entry/exit points. The webbing straps/cables 119*a*, 119*b* may be made using any suitable materials, for example, but not limited to nylon, steel, polypropylene etc.

Figure 2B:
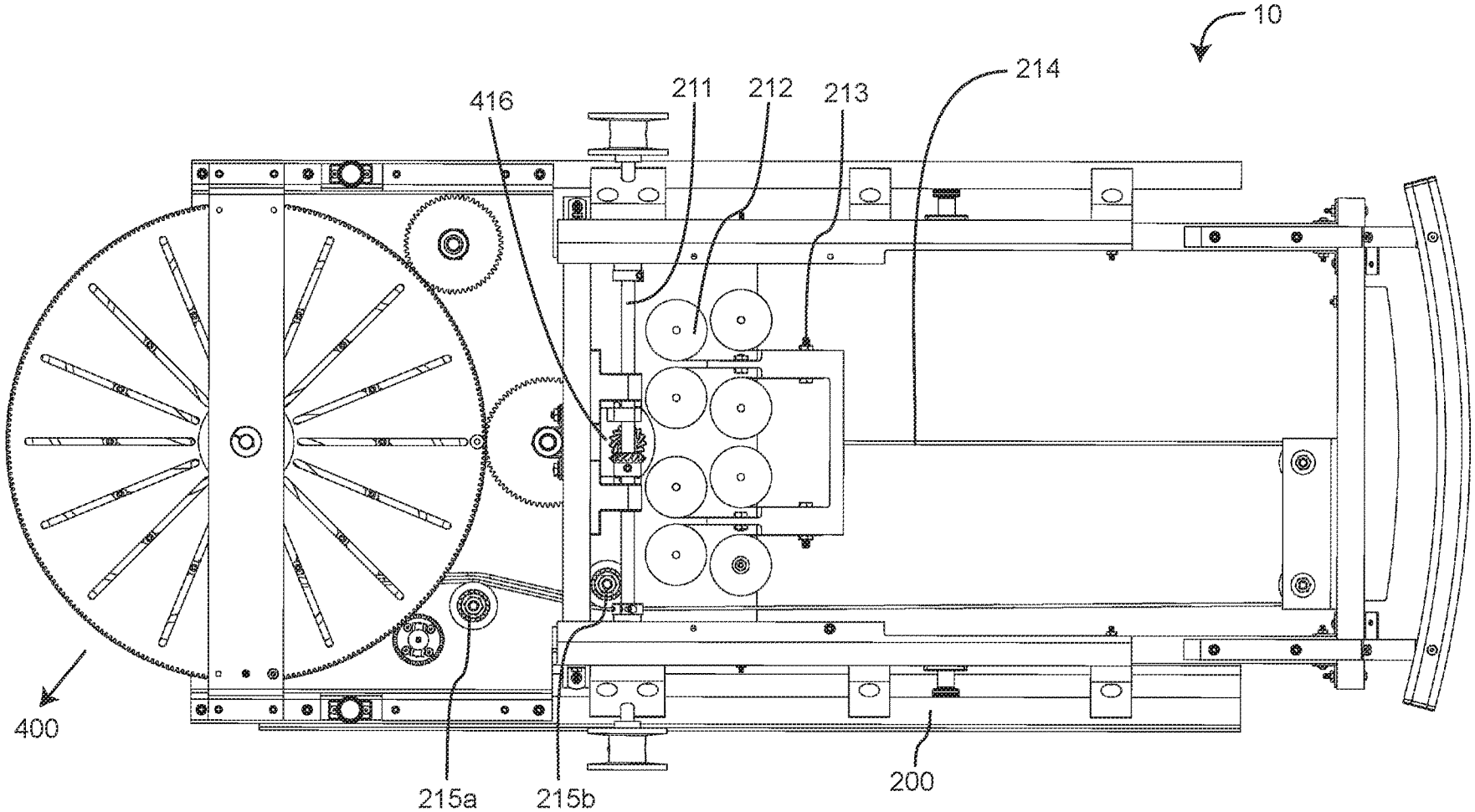
FIG. 2B is a top view of the exercise apparatus 10 of FIG. 2A depicting internal arrangement of various components according to a preferred embodiment.

Hereinafter, embodiments related to various internal components of the exercise apparatus 10 and their arrangement will be discussed in detail with reference to the figures. Referring to FIGS. 2A and 2B, various internal components of the exercise apparatus 10 include chassis 200 (described supra), a shaft 211, a plurality of resistance members generally depicted as 212; a cable/pulley system comprising a bracket 213, a cable 214, a plurality of sheaves 215*a*, 215*b*, 215*c*, 215*d*; a variable transmission 400; and, a plurality of mounting brackets (not shown) to mount variable transmission 400 on the chassis 200.

Figure 4B:
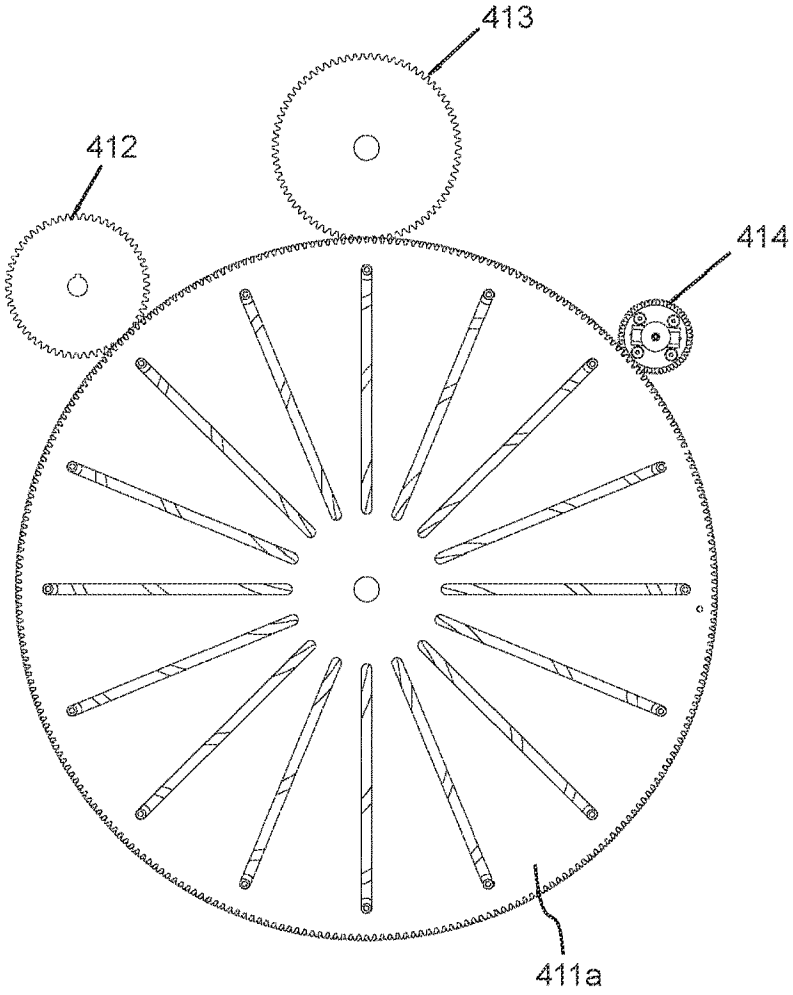
FIG. 4B shows a top view of the variable transmission 400 of FIG. 4A in accordance with an illustrative embodiment.
Figure 4A:
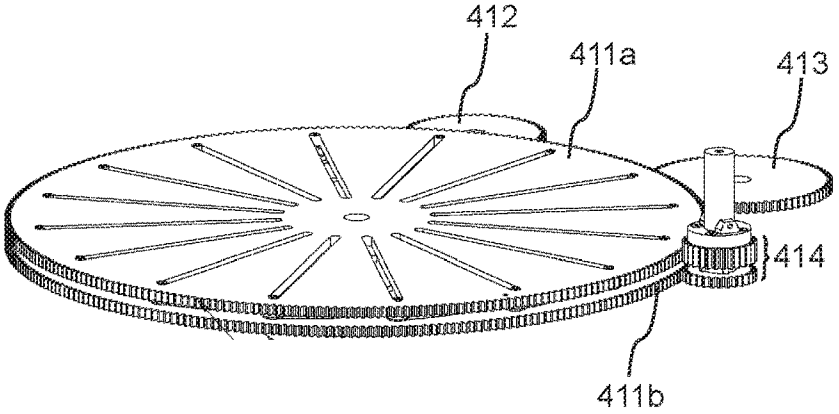
FIG. 4A shows a perspective view of the variable transmission 400 in accordance with an illustrative embodiment.
Figure 4C:
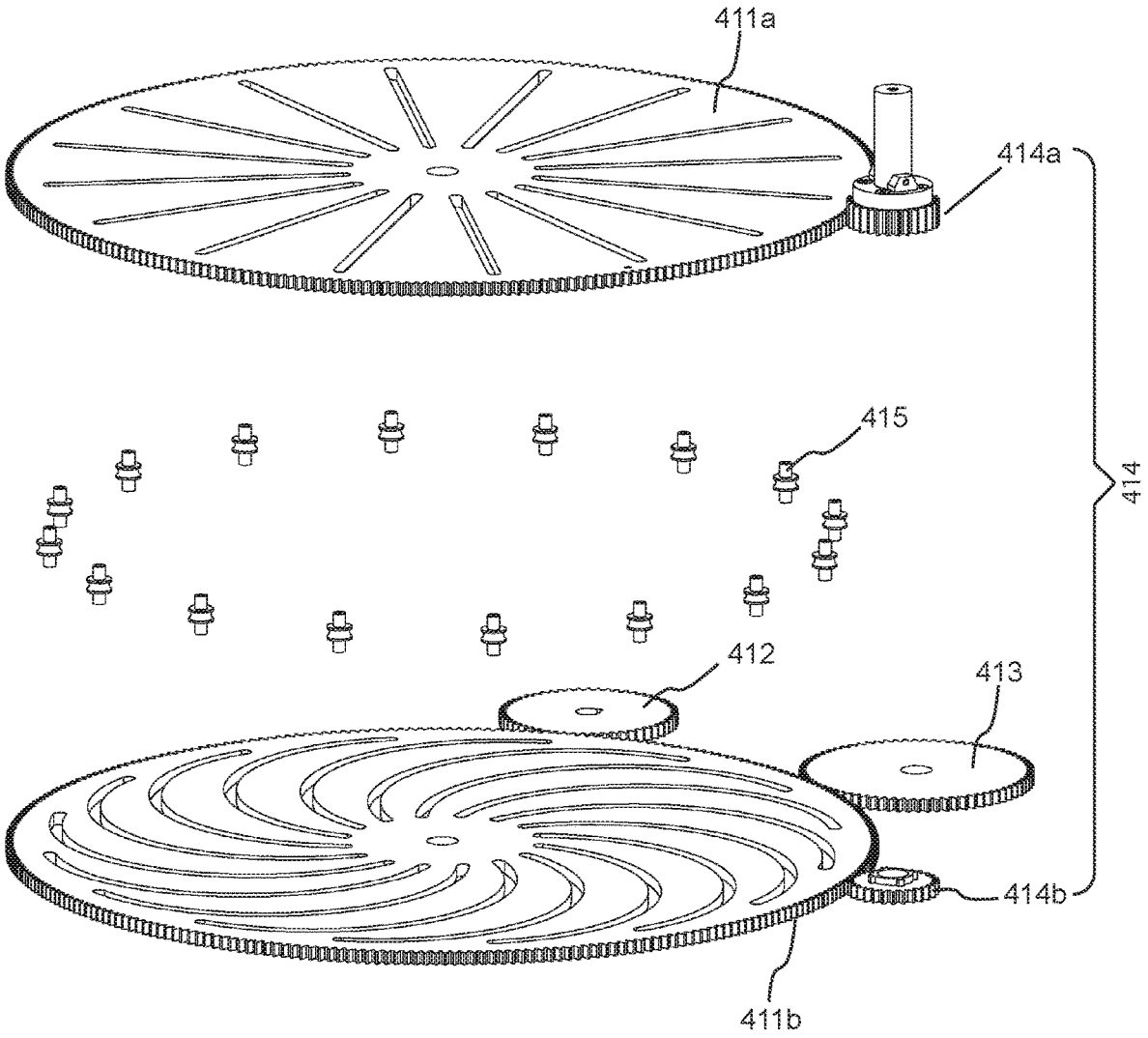
FIG. 4C shows an exploded view of the variable transmission 400 of FIG. 4A in accordance with an illustrative embodiment.

With reference to FIG. 4C, the variable transmission 400 comprises a top large gear 411*a* having a plurality of radial slots; a bottom large gear 411*b* having a plurality of curved/spiral slots; a plurality of slider bearings generally depicted as 415; a central spacer/hub (not shown) to stabilize the two large gears 411*a*, 411*b*; a locking idler drum gear assembly generally depicted as 414; a resistance adjustment/idler gear 412; a drive/output gear 413; a bevel gear pair arrangement 416.

In accordance with a preferred embodiment of the present invention, the exercise apparatus 10 uses a constant source of resistance which resistance force is reduced over a wide range of gear-ratios by the variable transmission 400. The constant source of resistance is utilized for loading the hips/hip muscles of the user during performance of a hip strengthening exercise, for example, weighted hip thrust exercise. The constant source of resistance employed in preferred embodiments includes at least one resistance member. The resistance member usable with the exercise apparatus 10 is selected from the group comprising a mechanical tension spring, a mechanical strut, a constant force spring, a gas spring, an air piston, a magnetic spring or a combination thereof. Preferably, the resistance member is one or a plurality of constant force spring(s) of a desired aggregate resistance force.

The constant force springs are able to provide a wide range of constant force resistance to the user. The constant force springs are also advantageous as these springs have high cycle rate, allow fast stroke speeds and generally have simple attachment and mounting requirements. In another preferred embodiment, the exercise apparatus 10 employs a plurality of constant force springs in order to achieve a desired resistance force. The plurality of constant force springs may be connected in a series arrangement, a parallel arrangement or a combination thereof. Preferably, the plurality of constant force springs are connected in a parallel arrangement. As seen in FIG. 2A, the exercise apparatus 10 comprises a bank of constant force springs generally depicted as 212. In some embodiments, a Constant Torque Motor(s) may be used in place of constant force springs, or a larger constant force spring may be provided on a central hub/spool.

In an alternate embodiment, the resistance member used is a gas spring or a magnetic spring of a desired resistance force. The gas springs or magnetic springs also have the ability to provide a constant resistance force throughout a stroke and allow fast stroke speeds. It is also contemplated to use a plurality of gas springs or magnetic springs in a series arrangement, a parallel arrangement or a combination thereof, preferably in a parallel arrangement, in order to achieve a desired resistance force. Particularly in case of magnetic springs, the exercise apparatus 10 of the present invention may also include a geared pulley arrangement to enhance the stroke length, for example converting a short stroke length into a longer stroke length.

The desired resistance force in accordance with various embodiments of the present invention is in range from at least 10 lbs. to 850 lbs., preferably from at least 100 lbs. to 900 lbs., more preferably from at least 150 lbs. to 500 lbs.

and, most preferably from at least 200 lbs. to 350 lbs. All individual values and sub-ranges from 10 lbs. to 850 lbs. are contemplated herein. The variable transmission 400 of the present invention can be configured to reduce the resistance force to between 10 lbs. to 1000 lbs. force range. In one embodiment, the constant spring force provides 200 lbs (8×25 lbs) of resistance and the transmission output is approximately 46-182 lbs. There may be additional friction/drag forces applied within this range.

In an alternate embodiment, the exercise apparatus 10 may use incremental resistance mechanisms connected to the variable transmission 400 to further extend the resistance force range. For example, 50 lbs. to 200 lbs. incremental resistance force sources may be used to allow for a wide resistance force range selectable by the user.

Figure 2C:
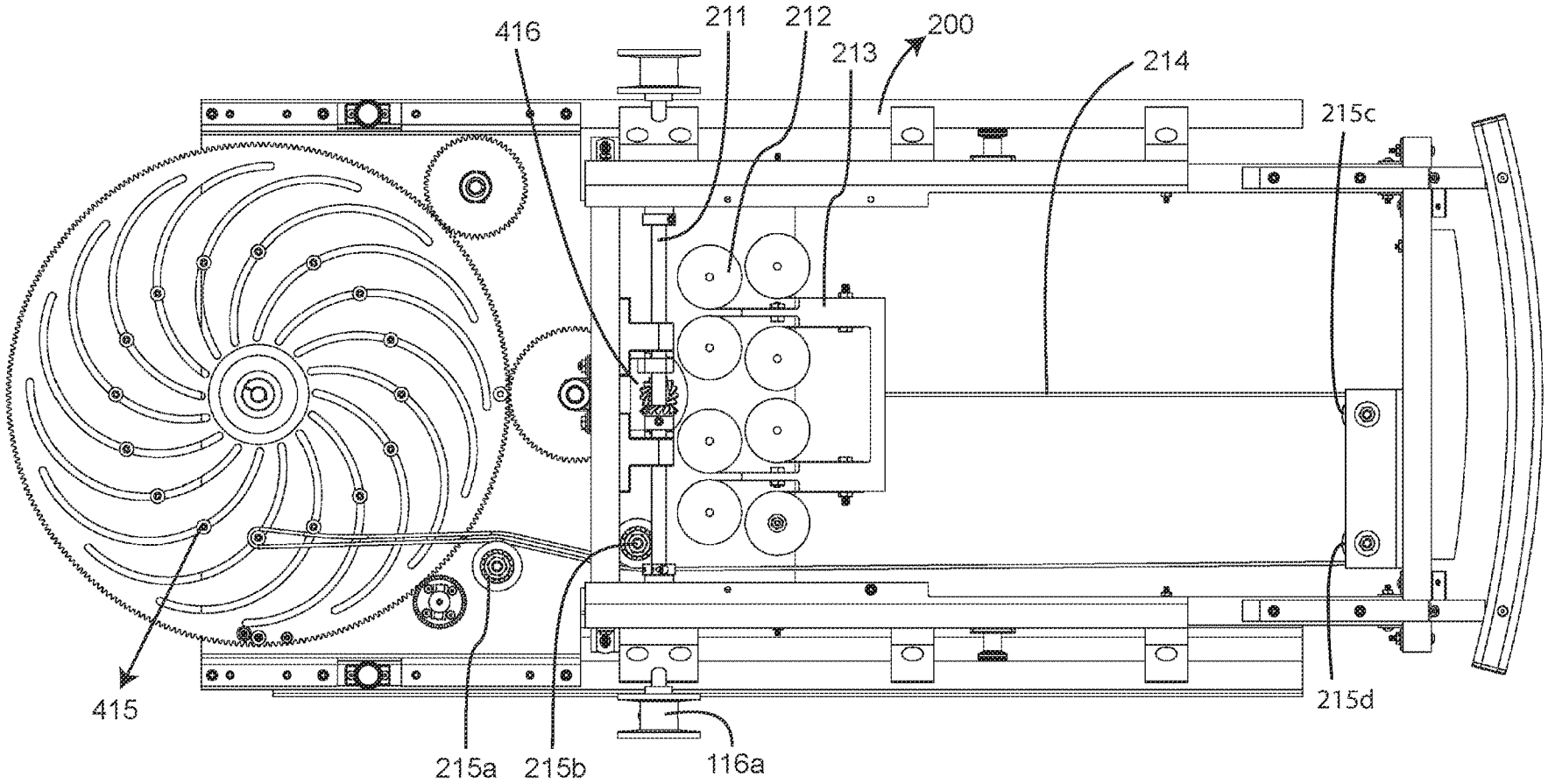
FIG. 2C is an alternate top view of the exercise apparatus 10 of FIG. 2A depicting internal arrangement of various components (with top large gear 411*a* hidden)

In accordance with preferred embodiments of the present invention, the bank of resistance members 212 is housed inside the chassis 200 under the seat/pylon 118 and is connected to the variable transmission 400 via the cable/pulley system, as seen in FIG. 2C. The cable 214 is provided to operatively couple the bank of resistance members 212 and the variable transmission 400. One end of the cable 214 is anchored to at least one of the slider bearings 415 as seen in FIG. 4C or wrapped around the slider bearings 415, after passing over the plurality of sheaves 215*a*, 215*b*, 215*c* and 215*d*, such that the radial position of the slider bearings 415 within the slots establishes a gear ratio applied during actuation of the bank of the resistance members 212. The other end of the cable 214 is connected via bracket 213 to the bank of resistance members 212. When the top and bottom large gears 411*a* and 411*b* rotate simultaneously, the cable 214 wraps around the plurality of slider bearings 415 to form a variable-diameter pulley.

In an alternative embodiment, the cable 214 may be substituted by a belt or other suitable linkage. In another embodiment, the cable 214 may be substituted by a chain and the plurality of sheaves/pullies 215*a*, 215*b*, 215*c* and 215*d* may be substituted by a plurality of sprockets or alternative guides.

Referring to FIG. 2C, two sheaves 215*a*, 215*b* are mounted towards the rear portion 200*a* of the chassis 200. The other two sheaves 215*c*, 215*d* are mounted towards the front portion of the chassis 200. It may be noted that the number and the arrangement of the sheaves is for illustrative purpose only. The exercise apparatus 10 of the present invention may use any number of sheaves, arranged in any suitable configuration. The actual number and arrangement of the sheaves would depend upon the design characteristics of the exercise apparatus 10 and the requirements, as they may be.

Now turning to the variable transmission 400, FIGS. 4A and 4C show a perspective and an exploded view of the variable transmission 400, respectively, in accordance with an illustrative embodiment of the present invention. Both the large gears 411*a* and 411*b* have a vertical spacing between them maintained by the central hub/spacer (shown in FIG. 2C). The gear tooth shape or profile of the large gears 411*a*, 411*b* depends upon specific use and requirements of the exercise apparatus 10. Preferably, the large gears 411*a*, 411*b* are selected from the group consisting of spur, helical and bevel gears. More preferably, the large gears 411*a*, 411*b* are spur gears.

As seen in FIG. 4C, each slider bearing 415 has a shaft and a capstan disposed at the center of the said shaft, wherein each slider bearing 415 is sandwiched between the top and bottom large gears 411*a*, 411*b*. Each end of the shaft enters its respective slot while the capstans are left free to rotate over the shaft in the space between the large gears 411*a*, 411*b*. The slider bearings 415 can move radially inward or outward within their respective slots based on the rotational positioning of the top large gear 411*a* relative to the bottom large gear 411*b*. For example, a first rotational position of the top large gear 411*a* relative to the bottom large gear 411*b* creates a first gear ratio by positioning the slider bearings 415 fully radially inward within the slots. A second rotational position of the top large gear 411*a* relative to the bottom large gear 411*b* creates a second gear ratio by positioning the slider bearings 415 fully radially outward within the slots. And a wide range of gear ratios is selectable between the first and second ratios.

Figure 4D:
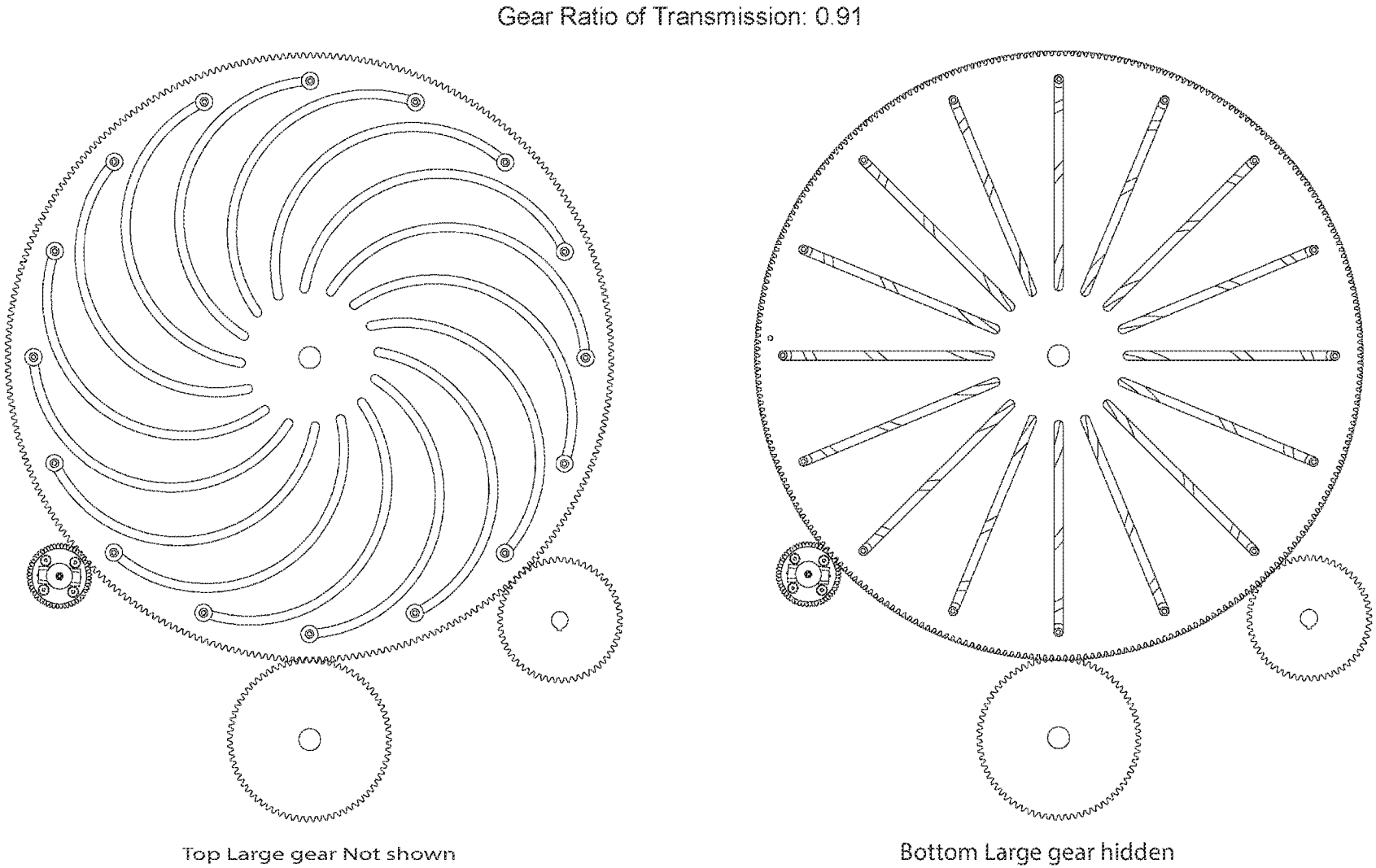
FIG. 4D shows a top view of the variable transmission 400 of FIG. 4A set at a gear ratio of 0.91 in accordance with an illustrative embodiment.
Figure 4E:
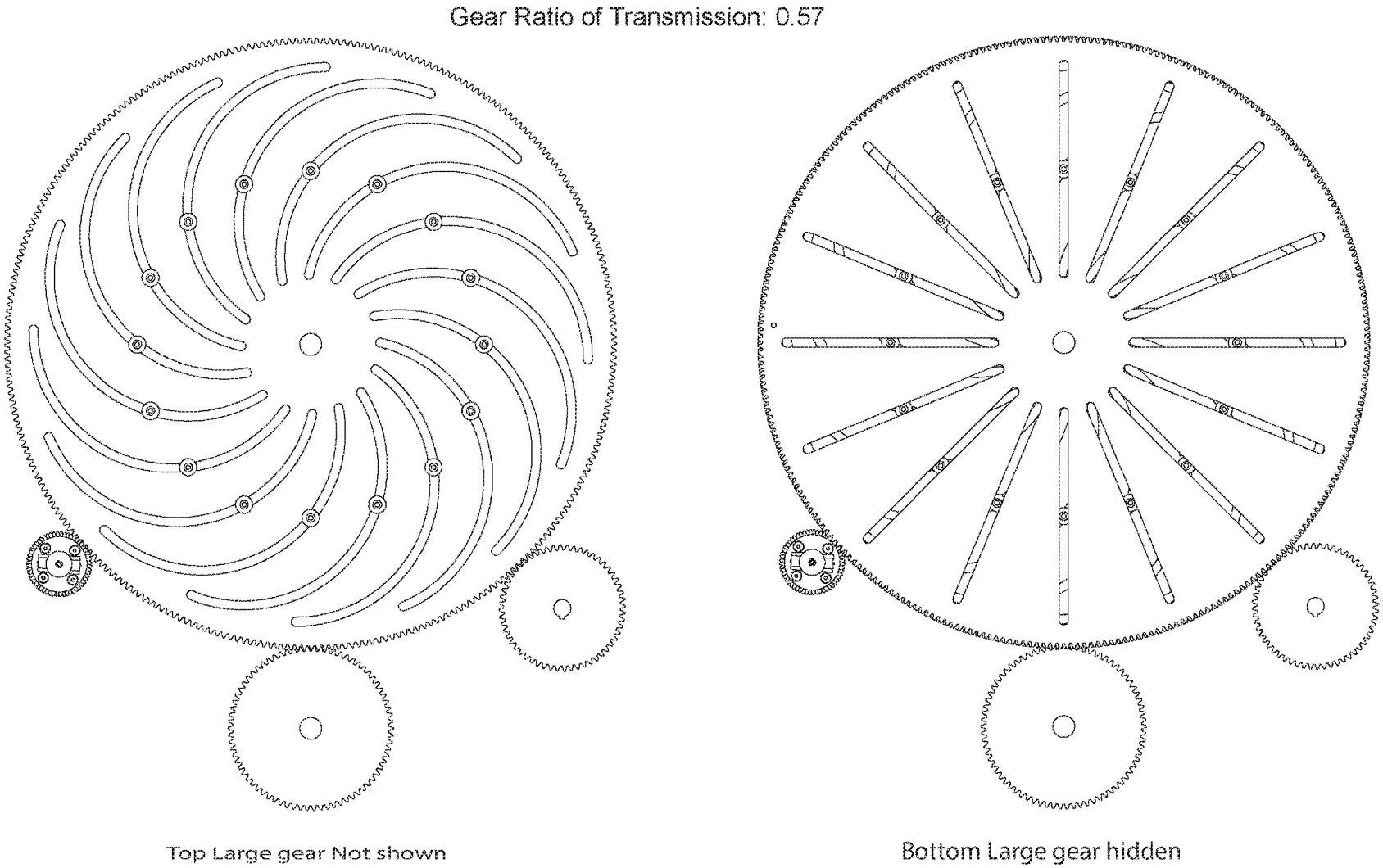
FIG. 4E shows a top view of the variable transmission 400 of FIG. 4A set at a gear ratio of 0.57 in accordance with an illustrative embodiment; and, FIG. 4F shows a top view of the variable transmission 400 of FIG. 4A set at a gear ratio of 0.23 in accordance with an illustrative embodiment.
Figure 4F:
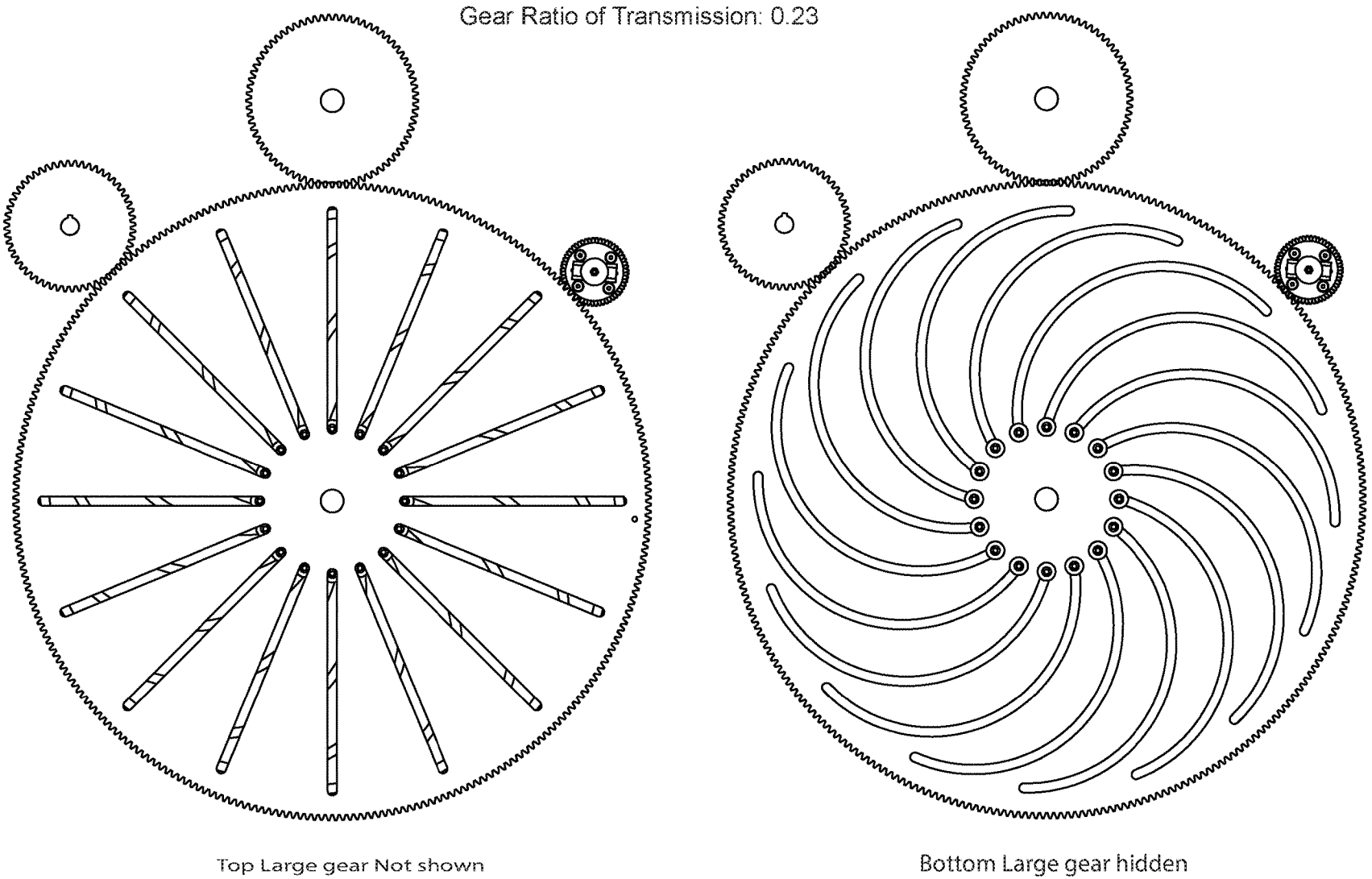

In accordance with various embodiments of the present invention, FIG. 4D shows a top view of the variable transmission 400 set at a gear ratio of about 0.91. FIG. 4E shows a top view of the variable transmission 400 set at a gear ratio of about 0.57 in accordance with various embodiments of the present invention. FIG. 4F shows a top view of the variable transmission 400 set at a gear ratio of about 0.23 in accordance with various embodiments of the present invention.

Above-mentioned figures are for illustrative purposes only. A theoretical infinite range of gear ratios may be established by any number of rotational positions of the top large gear 411*a* relative to the bottom large gear 411*b*, with the full range of radial positions of the slider bearings 415 within the slots.

In accordance with preferred embodiments, the locking idler drum gear assembly 414 engages with the teeth of both aforementioned large gears 411*a*, 411*b*. Attached to this drum gear is the lock pull knob 120 that controls the movement of the locking idler drum gear assembly 414 along with the locking and synchronization (discussed hereinafter) of the two large gears 411*a*, 411*b*.

As seen in FIG. 4C, the locking idler drum gear assembly 414 comprises two independent halves of locking idler drum gear 414*a* and 414*b*. The first half locking idler drum gear 414*a* engages with the teeth of the straight/radially slotted large gear 411*a* and the second half locking idler drum gear 414*b* engages with the teeth of the spiral slotted large gear 411*b*. The two half locking idler drum gears 414*a*, 414*b* can be re-engaged with one another, effectively creating one large locking drum gear assembly 414, simultaneously engaged with the teeth of both large gears 411*a*, 411*b*.

The idler gear 412 is connected to the adjustment knob 117. The idler gear 412 engages with the teeth of the spiral slotted large gear 411*b*. The adjustment knob 117 allows the user to turn this idler gear 412 and adjust the gear ratio (discussed hereinafter) of the variable transmission 400.

The drive/output gear 413 also engages with the teeth of the spiral slotted large gear 411*b*. Alternatively, drive/output gear 413, can be implemented to engage large gear 411*a*. The drive/output gear 413 is also operatively engaged with the spools 116*a*, 116*b* via the bevel gear pair arrangement 416. As seen in FIG. 2C, the spools 116*a*, 116*b* are connected to the shaft 211 onto which the bevel gear pair arrangement 416 is mounted. The arrangement 416 employed in the present invention can be of any type known in the art. Preferably, the arrangement 416 is hypoid gear pair. Further, additional gearing, idlers, and bevel gears etc. can be added to the arrangement 416 to redirect or effectively engage it with the drive/output gear 413.

Hereinafter, the working of the variable transmission 400 and of the exercise apparatus 10 will be described in detail.

In accordance with various embodiments of the present invention, the variable transmission 400 acts as a variable diameter pulley to translate and transfer fractions of a greater resistance force to the user. To perform a weighted hip thrust exercise using the exercise apparatus 10, the user first positions his/her upper back on the shoulder/back support 112, feet on the foot platform 111 and loads his/her hips with the cross member 300 by placing the cross member 300 across his/her lap. The user then performs a hip thrust upwards, hence moving the cross member 300 in upward direction. The cross member 300 is further connected to the spools 116*a*, 116*b* via webbing straps/cables 119*a*, 119*b*. The upward force pulls the webbings straps/cables 119*a*, 119*b*, turns the spools 116*a*, 116*b*, which in turn drives the variable transmission 400. The variable transmission 400 actuates the bank of resistance members 212, e.g., constant force springs, via the cable/pulley system (described supra). The variable transmission 400 serves to reduce the amount of input force required to overcome the resistance force provided by the resistance members 212 during flexing of the user's hip joint and glute muscles during the upward action of hip extension. For example, a single constant non-adjustable 200 lbs. resistance force can be mechanically reduced within an adjustable range of 45-180 lbs. required input force. The effective resistance force range is governed by the ratio of the inner most radius of the slots in the large gears 411*a*, 411*b*; the outer most radius of the slots in the large gears 411*a*, 411*b*; and, the radius of the large gears 411*a*, 411*b*.

The amount of effective resistance force and required input force can be readily adjusted by the user while the variable transmission 400 is at rest. The user can adjust loading levels at the turn of the adjustment knob 117, which modifies the gear ratio of the variable transmission 400.

When the variable transmission 400 is at rest and inert, in order to adjust the gear ratio, the straight slotted large gear 411*a* is held still, and the spiral slotted large gear 411*b* is rotated relative to it. In one preferred embodiment, this can be achieved by splitting the locking idler drum gear assembly 414. The user pulls the lock pull knob 120 which causes the locking idler drum gear assembly 414 to split vertically into two independent halves—the locking idler drum gear 414*a* and 414*b*. The first half locking idler drum gear 414*a* engages with the teeth of the straight/radially slotted large gear 411*a* and the second half locking idler drum gear 414*b* engages with the teeth of the spiral slotted large gear 411*b*. This split allows the large gears 414*a*, 414*b* to rotate independently. The first half locking idler drum gear 414*a* engaged with the straight slotted large gear 411*a* can be locked in position through an engagement with a slot or protrusion in its mounting bracket, for holding the straight slotted large gear 411*a* still while adjusting the gear ratio.

The user then turns the adjustment knob 117 in a desired direction to choose a gear ratio and/or a desired loading level. The adjustment knob 117 is provided with a plurality of markings indicating various gear ratios and/or loading levels. Twisting and setting the adjustment knob 117 to a certain marking causes the idler gear 412 to rotate by an appropriate amount. The idler gear 412 is operatively engaged with the spiral slotted large gear 411*b*, hence causing the spiral slotted large gear 411*b* to rotate, whilst the straight slotted large gear 411*a* is held at rest. The idler gear 412 is much smaller than the spiral slotted large gear 411*b*, hence larger, user-friendly hand motions by the user result in small precise movement of the large gear 411*b*. When the spiral slotted large gear 411*b* rotates relative to straight slotted large gear 411*a*, the radius of the overlap position of their respective slots changes, causing the slider bearings 415 to slide within the slots and follow this change to a resulting slot overlap position. An adjustable diameter pulley is the resulting effect and thus a desired gear ratio is achieved.

In order to maintain the diameter of the pulley during use under load, i.e., during the exercise, the relative motion between the two large gears 411*a* and 411*b* must be avoided so that the slider bearings 415 are no longer able to slide within the slots of the large gears 411*a*, 411*b*. This can be accomplished by re-engaging the two half locking idler drum gears 414*a*, 414*b* by using the lock pull knob 120 and, effectively creating one large locking idler drum gear assembly 414 which simultaneously engages with the outer teeth of both large gears 411*a*, 411*b*. The locking idler drum gear assembly 414 prevents the two slotted large gears 411*a*, 411*b* from rotating relative to each other, thus maintaining the slot overlap position and the diameter of the pulley created by the position of slider bearings 415 within their slots, thereby maintaining the gear ratio.

When the user performs a hip thrust movement in an upward direction, the upward force pulls the webbings straps/cables 119*a*, 119*b*, turns the spools 116*a*, 116*b*, which in turn rotates the drive/output gear 413 via the bevel gear pair arrangement 416. The drive/output gear 413 meshes with the outer teeth of the spiral slotted large gear 411*b*, thereby causing both large gears 411*a*, 411*b* to rotate. The cable 214 is anchored to at least one of the slider bearings 415 and wraps around the pulley created by the slider bearings 415, pulling on the bank of resistance members 212 attached at the other end of the cable 214. As the radius of the pulley created by the slider bearings 415 within the large gears 411*a*, 411*b* is smaller, a smaller driving force is felt at the outer teeth of the large gears 411*a*, 411*b* than the force on the cable 214 being wrapped about the slider bearings 415. Hence, the variable transmission 400 of the present invention translates and transfer fractions of a greater input resistance force onwards to an output force receiving user.

In another embodiment, the functions of the idler gear 412 and locking idler drum gear assembly 414 can be combined into a single locking idler drum gear assembly comprising two independent locking idler drum gears—a first idler drum gear and a second idler drum gear. In light of previous embodiments, the first idler drum gear is an equivalent of first half locking idler drum gear 414*a* and the second idler drum gear is an equivalent of second half locking idler gear 414*b*. However, in this particular embodiment, the second idler gear also performs the function of gear ratio adjustment which was earlier performed by the idler gear 412. In this case, idler gear 412 would become redundant and hence can be removed from the variable transmission. It may be noted the working of this modified variable transmission is similar to the variable transmission 400 of the previous embodiments, hence the description thereof has been skipped.

Furthermore, the adjustment knob 117 and lock pull knob 120 can also be optionally combined into a single knob to allow the user to choose a gear ratio and/or a desired loading level as well as perform locking/unlocking of the said locking idler drum gear assembly. As alternative to manual operation of the adjustment knob, an electronic/remote actuator may be used to adjust idler gear 412, or the locking gear 414*a*&*b*.

In various embodiments, the drive/output gear 413 may be engaged with further gears of desired ratios and types to further multiply or redirect the direction of the output force required by the user to drive the variable transmission 400. Further gearing, idlers, and bevel gears etc. can be added to this transmission to further multiply or redirect the output/driving forces of the transmission.

Finally, while the present invention has been described above with reference to various exemplary embodiments, many changes, combinations and modifications may be made to the exemplary embodiments without departing from the scope of the present invention. For example, the various components may be implemented in alternative ways. These alternatives can be suitably selected depending upon the particular application or in consideration of any number of factors associated with the operation of the device. In addition, the techniques described herein may be extended or modified for use with other types of devices. These and other changes or modifications are intended to be included within the scope of the present invention.

What is claimed is:

1. An exercise apparatus for performing hip strengthening exercises comprising:

(a) a chassis having a front portion and a rear portion;

(b) a cross-member movably coupled to the chassis and configured to engage the hips of a user, wherein the cross-member is configured to act against a resistance force during hip thrusts by a user;

(c) a foot platform provided towards the rear portion of the chassis;

(d) at least one resistance member coupled to the chassis and configured to be actuated by movement of the cross-member; and (e) a variable transmission comprising at least one slider bearing disposed within at least one pair of slots defined in cooperative first and second large gears, the variable transmission configured to adjust an input force required to actuate the resistance member, wherein the variable transmission is adjustable across a range of adjustment ratios by selecting a radial position of the at least one slider bearing disposed within the at least one pair of slots defined in cooperative first and second large gears.

2. The exercise apparatus of claim 1 wherein the cross-member further includes a pad contoured to ergonomically engage the hips of a user.

3. The exercise apparatus of claim 1, wherein the at least one resistance member comprises a plurality of resistance members.

4. The exercise apparatus of claim 1, wherein the at least one resistance member is selected from the group consisting of a mechanical tension spring, a mechanical strut, a constant force spring, a gas spring, an air piston, a magnetic spring or a combination thereof.

5. The exercise apparatus of claim 1, further comprising a shoulder/back support provided towards the front portion of the chassis, wherein the shoulder/back support is mounted on a support frame, wherein the support frame can be positioned in multiple fore-and-aft positions with respect to the chassis and allows the shoulder/back support to be located outside the chassis in an elevated position during the use of the exercise apparatus.

6. The exercise apparatus of claim 1, wherein the exercise apparatus further includes an adjustment mechanism configured to adjust a desired adjustment ratio of the variable transmission.

7. An exercise apparatus for performing hip strengthening exercises comprising:

(a) a chassis;

(b) a cross-member moveably coupled to the chassis and configured for movement in response to hip thrust movements of a user;

(c) at least one resistance member coupled to the chassis and configured to provide a resistance force against movement of the cross-member;

(d) a variable transmission configured to adjust the input force required at the cross-member to overcome the resistance force of the resistance member; and (e) an adjustment mechanism configured to adjust a desired adjustment ratio of the variable transmission.

8. The exercise apparatus of claim 7, wherein the adjustment mechanism includes a plurality of markings indicating various adjustment ratios and/or loading levels.

9. The exercise apparatus of claim 7, wherein the at least one resistance member comprises a plurality of resistance members, at least one resistance member of the plurality of resistance members is selected from the group consisting of a mechanical tension spring, a mechanical strut, a constant force spring, a gas spring, an air piston, a magnetic spring or a combination thereof.

10. An exercise apparatus comprising:

(a) a chassis;

(b) a cross-member movably coupled to the chassis;

(c) at least one resistance member coupled to the chassis and actuatable by movement of the cross-member; and (d) a variable transmission comprising a first large gear with a plurality of slots extending radially, a second large gear with a plurality of curved slots, a plurality of slider bearings disposed within cooperative slots of the first and second large gears, wherein the variable transmission is adjustable to adjust a degree of input force required for movement of the cross-member to overcome the resistance force of the resistance member.

11. The exercise apparatus of claim 10, further comprising a locking idler drum gear assembly comprising a first half locking idler drum gear and a second half locking idler drum gear, an idler gear configured to engage the first large gear, a drive/output gear configured to engage the second large gear, wherein said idler gear is configured to change the position of the slider bearings in their slots by rotating the first large gear when the first and second half locking idler drum gears are disengaged from one another and the second large gear is held still, wherein said locking idler drum gear assembly is configured to prevent independent rotation of the first and second large gears and displacement of slider bearings within their respective slots under load when the first and second half locking idler drum gears are engaged with one another.

12. The exercise apparatus of claim 10, wherein the at least one resistance member comprises a plurality of resistance members, wherein at least one resistance member of the plurality of resistance members is selected from the group consisting of a mechanical tension spring, a mechanical strut, a constant force spring, a gas spring, an air piston, a magnetic spring or a combination thereof.

13. The exercise apparatus of claim 10, wherein the exercise apparatus further includes an adjustment knob provided with a plurality of markings indicating various adjustment ratios and/or loading levels, configured to adjust the desired adjustment ratio of the variable transmission.

14. The exercise apparatus of claim 10, wherein the adjustment knob is connected to the idler gear and allows the user to turn the idler gear.

15. A variable transmission for use with an exercise apparatus comprising:

(a) a variable transmission comprising a top large gear with a plurality of slots extending radially, a bottom large gear with a plurality of curved slots, and a plurality of slider bearings, each slider bearing being moveable within one radial slot and one curved slot of the top and bottom large gears respectively;

(b) a resistance cable operatively coupled to at least one of the slider bearings of the variable transmission such that rotation of the variable transmission serves to tension the resistance cable; and (c) an adjustment mechanism coupled to the plurality of slider bearings and configured to adjust the desired adjustment ratio of the variable transmission by radially positioning the plurality of slider bearings disposed within the respective slots to establish an adjusted input force required to overcome the resistance of the resistance cable.

16. The variable transmission of claim 15, further comprising:

a locking idler drum gear assembly comprising a first half locking idler drum gear and a second half locking idler drum gear, an idler gear configured to engage the bottom large gear, and an idler gear configured to change the position of the slider bearings in their slots by rotating the bottom large gear when first and second half locking idler drum gears are disengaged from one another and the top large gear is held still, whereby an effective diameter of a resistance cable path is adjusted, wherein the locking idler drum gear assembly is configured to prevent independent rotation of the top and bottom large gears and hence the displacement of slider bearings within their respective slots under load when the first and second half locking idler drum gears are engaged with one another.

17. The variable transmission of claim 16, wherein an adjustment knob is connected to the idler gear and allows the user to turn the idler gear to vary the position of the slider bearings within their respective slots to establish a desired effective diameter of a resistance cable path and corresponding adjustment ratio for overcoming a resistance force of the exercise apparatus.

* * * * *